US011919061B2

(12) United States Patent
Komarasamy et al.

(10) Patent No.: US 11,919,061 B2
(45) Date of Patent: Mar. 5, 2024

(54) SHEAR-ASSISTED EXTRUSION ASSEMBLIES AND METHODS

(71) Applicant: Battelle Memorial Institute, Richland, WA (US)

(72) Inventors: Mageshwari Komarasamy, Richland, WA (US); Scott A. Whalen, West Richland, WA (US); Brian K. Milligan, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 17/944,932

(22) Filed: Sep. 14, 2022

(65) Prior Publication Data

US 2023/0078467 A1 Mar. 16, 2023

Related U.S. Application Data

(60) Provisional application No. 63/244,632, filed on Sep. 15, 2021.

(51) Int. Cl.
*B21C 23/04* (2006.01)

(52) U.S. Cl.
CPC ..... *B21C 23/04* (2013.01)

(58) Field of Classification Search
CPC ..... B21C 23/04; B21C 23/002
See application file for complete search history.

(56) References Cited

U.S. PATENT DOCUMENTS 3,432,369 A 3/1969 Naastepad
3,640,657 A 2/1972 Rowe et al.
3,661,726 A 5/1972 Denes
3,684,593 A 8/1972 Benz et al.
3,884,062 A 5/1975 Green
3,892,603 A 7/1975 Reid
3,933,536 A 1/1976 Doser et al.
3,977,918 A 8/1976 Paladino et al.
3,989,548 A 11/1976 Morris
(Continued)

FOREIGN PATENT DOCUMENTS

CN 106140847 A 11/2016
CN 107282671 A 10/2017
(Continued)

OTHER PUBLICATIONS

WO PCT/US22/43532 Search Rept, dated Jan. 12, 2023, Battelle Memorial Institute.
(Continued)

*Primary Examiner* — Teresa M Ekiert
(74) *Attorney, Agent, or Firm* — Schwegman, Lundberg & Woessner, P.A.

(57) ABSTRACT

Shear-assisted extrusion assemblies are provided. The assemblies can include a billet containing assembly containing a billet comprising a billet outer material and a billet inner material in at least one cross-section; a tool operably engaged with the billet; an extrudate receiving channel configured to receive extrudate from the tool, wherein the extrudate comprises extruded outer material and extruded inner material in at least one cross-section, the extruded outer material being the same material as the billet outer material, and the extruded inner material being the same as the billet inner material. Methods for producing multi-material shear-assisted extrudate are also provided.

20 Claims, 23 Drawing Sheets

(56) References Cited

U.S. PATENT DOCUMENTS

| | | | |
|---|---|---|---|
| 4,287,749 | A | 9/1981 | Bachrach et al. |
| 4,300,378 | A | 11/1981 | Thiruvarudchelvan |
| 4,585,473 | A | 4/1986 | Narasimhan et al. |
| 4,778,542 | A | 10/1988 | Clemens |
| 4,801,340 | A | 1/1989 | Inoue et al. |
| 4,808,224 | A | 2/1989 | Anderson et al. |
| 4,892,596 | A | 7/1990 | Chatterjee |
| 4,985,085 | A | 1/1991 | Chatterjee |
| 5,026,438 | A | 6/1991 | Young et al. |
| 5,089,060 | A | 2/1992 | Bradley et al. |
| 5,242,508 | A | 9/1993 | McCallum et al. |
| 5,262,123 | A | 11/1993 | Thomas et al. |
| 5,283,130 | A | 2/1994 | Bradley et al. |
| 5,437,545 | A | 8/1995 | Hirai |
| 5,461,898 | A | 10/1995 | Lessen |
| 5,470,401 | A | 11/1995 | McCallum et al. |
| 5,492,264 | A | 2/1996 | Wadleigh |
| 5,737,959 | A | 4/1998 | Korbel et al. |
| 5,739,498 | A | 4/1998 | Sunamoto et al. |
| 5,964,117 | A | 10/1999 | Holroyd et al. |
| 5,988,484 | A | 11/1999 | Osborn et al. |
| 6,022,424 | A | 2/2000 | Sellers et al. |
| 6,036,467 | A | 3/2000 | Jameson |
| 6,638,462 | B2 | 10/2003 | Davidson et al. |
| 6,843,405 | B2 | 1/2005 | Okamoto et al. |
| 6,940,379 | B2 | 9/2005 | Creighton |
| 7,096,705 | B2 | 8/2006 | Segal |
| 7,314,670 | B2 | 1/2008 | Bartsch et al. |
| 7,322,508 | B2 | 1/2008 | Chang |
| 7,954,692 | B2 | 6/2011 | Fukuda |
| 8,016,179 | B2 | 9/2011 | Burford |
| 8,240,540 | B2 | 8/2012 | Tanaka et al. |
| 8,313,692 | B2 | 11/2012 | Somekawa et al. |
| 8,695,868 | B2 | 4/2014 | Messer et al. |
| 10,189,063 | B2 | 1/2019 | Lavender et al. |
| 10,369,748 | B2 | 8/2019 | Whalen et al. |
| 10,695,811 | B2 | 6/2020 | Joshi et al. |
| 11,045,851 | B2 | 6/2021 | Joshi et al. |
| 2002/0029601 | A1 | 3/2002 | Kwok |
| 2004/0057782 | A1 | 3/2004 | Okamoto et al. |
| 2004/0238501 | A1 | 12/2004 | Kawazoe et al. |
| 2004/0265503 | A1 | 12/2004 | Clayton et al. |
| 2006/0005898 | A1 | 1/2006 | Lui et al. |
| 2006/0027628 | A1 | 2/2006 | Sutherlin et al. |
| 2008/0029581 | A1 | 2/2008 | Kumagai et al. |
| 2008/0048005 | A1 | 2/2008 | Forrest et al. |
| 2008/0202653 | A1 | 8/2008 | Ignberg |
| 2008/0251571 | A1 | 10/2008 | Burford |
| 2009/0072007 | A1 | 3/2009 | Nagano |
| 2009/0269605 | A1 | 10/2009 | Warke et al. |
| 2009/0291322 | A1 | 11/2009 | Watanabe et al. |
| 2010/0059151 | A1 | 3/2010 | Iwamura et al. |
| 2010/0089976 | A1 | 4/2010 | Szymanski et al. |
| 2010/0132430 | A1 | 6/2010 | Tsai et al. |
| 2011/0104515 | A1 | 5/2011 | Kou et al. |
| 2011/0132970 | A1 | 6/2011 | Nakagawa et al. |
| 2011/0309131 | A1 | 12/2011 | Hovanski et al. |
| 2012/0006086 | A1 | 1/2012 | Manchiraju et al. |
| 2012/0052322 | A1 | 3/2012 | Hatakeyama et al. |
| 2012/0168045 | A1 | 7/2012 | Ihara et al. |
| 2012/0223451 | A1 | 9/2012 | Hulseman et al. |
| 2012/0258332 | A1 | 10/2012 | Hatakeyama et al. |
| 2013/0075452 | A1 | 3/2013 | Burford |
| 2014/0000332 | A1 | 1/2014 | Wilson et al. |
| 2014/0002220 | A1 | 1/2014 | Johnson et al. |
| 2014/0076957 | A1 | 3/2014 | Sayama et al. |
| 2014/0102159 | A1 | 4/2014 | Denison |
| 2014/0102161 | A1 | 4/2014 | Stewart |
| 2014/0248508 | A1 | 9/2014 | Ohhama et al. |
| 2014/0283574 | A1 | 9/2014 | Lavender et al. |
| 2014/0291886 | A1 | 10/2014 | Mark et al. |
| 2014/0328710 | A1 | 11/2014 | Cui et al. |
| 2015/0075242 | A1 | 3/2015 | Eller et al. |
| 2015/0115019 | A1 | 4/2015 | Pascal et al. |
| 2015/0360317 | A1 | 12/2015 | Kalvala et al. |
| 2016/0008918 | A1 | 1/2016 | Burford |
| 2016/0151817 | A1 | 6/2016 | Nayfeh et al. |
| 2016/0151818 | A1 | 6/2016 | Shao |
| 2016/0167353 | A1 | 6/2016 | Fan et al. |
| 2016/0175981 | A1 | 6/2016 | Kandasamy |
| 2016/0175982 | A1 | 6/2016 | Kandasamy et al. |
| 2016/0184922 | A1 | 6/2016 | Kikyo |
| 2016/0228932 | A1 | 8/2016 | Hayashi et al. |
| 2016/0354860 | A1 | 12/2016 | Boettcher et al. |
| 2017/0008121 | A1 | 1/2017 | Li |
| 2017/0136686 | A1 | 5/2017 | Ueno et al. |
| 2017/0163135 | A1 | 6/2017 | Emberton et al. |
| 2017/0182587 | A1 | 6/2017 | Tokoro et al. |
| 2017/0216961 | A1 | 8/2017 | Utter et al. |
| 2017/0225265 | A1 | 8/2017 | Ito et al. |
| 2017/0304933 | A1 | 10/2017 | Miles et al. |
| 2017/0355003 | A1 | 12/2017 | TenHouten et al. |
| 2018/0036840 | A1 | 2/2018 | Hu et al. |
| 2018/0043467 | A1 | 2/2018 | Huysmans |
| 2018/0050419 | A1 | 2/2018 | Das et al. |
| 2018/0311713 | A1 | 11/2018 | Joshi et al. |
| 2018/0354231 | A1 | 12/2018 | Iwase |
| 2018/0369889 | A1 | 12/2018 | Zhang et al. |
| 2019/0267153 | A1 | 8/2019 | Kappagantula et al. |
| 2019/0275608 | A1 | 9/2019 | Das et al. |
| 2021/0086291 | A1 | 3/2021 | Okada et al. |
| 2021/0205918 | A1 | 7/2021 | Fujii et al. |
| 2021/0252632 | A1 | 8/2021 | Eller et al. |

FOREIGN PATENT DOCUMENTS

| | | |
|---|---|---|
| EP | 2990178 | 8/2014 |
| GB | 1258141 | 12/1971 |
| JP | 2003-275876 | 9/2003 |
| JP | 2007-222925 | 9/2007 |
| WO | WO PCT/US2019/040730 | 10/2019 |
| WO | 2023043839 | 3/2023 |

OTHER PUBLICATIONS

WO PCT/US22/43532 Written Opin, dated Jan. 12, 2023, Battelle Memorial Institute.

WO PCT/US2019/040730 IPRP, Jan. 5, 2021, Battelle Memorial Institute.

WO PCT/US2020/053168 IPRP, Apr. 7, 2022, Battelle Memorial Institute.

WO PCT/US2020/053168 Search Rpt, dated Feb. 8, 2021, Battelle Memorial Institute.

WO PCT/US2020/053168 Written Opin, dated Feb. 8, 2021, Battelle Memorial Institute.

WO PCT/US2021/050022 IPRP, Dec. 1, 2022, Battelle Memorial Institute.

WO PCT/US2021/050022 Search Rpt, dated Feb. 3, 2022, Battelle Memorial Institute.

WO PCT/US2021/050022 Weit. Opin., dated Feb. 3, 2022, Battelle Memorial Institute.

Abu-Farha, "A Preliminary Study on the Feasibility of Friction Stir Back Extrusion", Scripta Materials, 66, 2012, United States, 615-618.

Amancio-Filho et al., "Joining of Polymers and Polymer-Metal Hybrid Structures: Recent Developments and Trends", Polymer Engineering & Science, 2009, United States, pp. 1461-1476.

Bozzi et al., "Intermetallic Compounds in AI 6016/IF-Steel Friction Stir Spot Welds", Materials Science and Engineering, 2010, Netherlands, pp. 4505-4509.

Cole et al., "Lightweight materials for Automotive Applications", Materials Characterization, 35, 1995, United States, pp. 3-9.

Evans et al., "Friction Stir Extrusion: A new process for joining dissimilar materials", Manufacturing Letters, 5, 2015, United States, pp. 25-28.

Gann, J.A., "Magnesium Industry's Lightest Structural Metal", SAE Transactions, vol. 25-26, 1930-1931, United States, pp. 620-634, 641.

(56) References Cited

OTHER PUBLICATIONS

Hammond et al., "Equal-Channel Angular Extrusion of a Low-Density High-Entropy Alloy Produced by High-Energy Cryogenic Mechanical Alloying", JOM. Vol. 66, No. 10, United States, 2014, pp. 2021-2029.
Kaiser et al., "Anisotropic Properties of Magnesium Sheet AZ31", Materials Science Forum, vols. 419-422, Switzerland, 2003, pp. 315-320.
Kuo et al., "Fabrication of High Performance Magnesium/Carbon-Fiber/PEEK/Laminated Composites", Materials Transactions, vol. 44, No. 8 (2003), Japan, pp. 1613-1619.
Leitao et al., "Aluminum-steel lap joining by multipass friction stir welding", Materials and Design, 106, 2016, United States, pp. 153-160.
Liu et al., "A Review of Dissimilar Welding Techniques for Magnesium Alloys to Aluminum Alloys", Materials, 7, 2014, United States, pp. 3735-3757.
Liu et al., "Microstructure and mechanical properties of equimolar FeCoCrNi high entropy alloy prepared via powder extrusion", Intermetallics 75 (2016) , United States, pp. 25-30.
Luo, Alan, "Magnesium: Current and Potential Automotive Applications", JOM, 54(2), 2002, United States, pp. 42-48.
Martinsen et al., "Joining of Dissimilar Materials", CIRP Annals—Manufacturing Technology, 2015, United States, 21 pages.
Nakamura et al., "Tool Temperature and Process Modeling of Friction Stir Welding", (2018) Modern Mechanical Engineering, 8, 78-94.
Office Action for U.S. Appl. No. 14/222,468, filed Mar. 21, 2014, First named inventor Curtis A. Lavender, Notification date Nov. 6, 2015, 10 pages.
Office Action for U.S. Appl. No. 14/222,468, filed Mar. 21, 2014, First named inventor Curtis A. Lavender, Notification date Apr. 1, 2016, 10 pages.
Office Action for U.S. Appl. No. 14/222,468, filed Mar. 21, 2014, First named inventor Curtis A. Lavender, Notification date May 20, 2016, 3 pages.
Office Action for U.S. Appl. No. 14/222,468, filed Mar. 21, 2014, First named inventor Curtis A. Lavender, Notification date Jan. 26, 2017, 9 pages.
Office Action for U.S. Appl. No. 14/268,220, filed May 2, 2014, First Named Inventor Jun Cui, Notification date Dec. 1, 2015, 7 pages.
Pickens, "Aluminum Powder Metallurgy Technology for High-Strength Applications", Journal of Materials Science 16 (1981) 1437-1457, United Kingdom, 21 pages.
Rodewald et al. "Top Nd—Fe—B Magnets with Greater Than 56 MGOe Energy Density and 9.8 kOe Coercivity", IEEE Transactions on Magnetics, vol. 38, No. 5, 2002, United States, pp. 2955-2957.
Saha, "Aluminum Extrusion Technology, Chapter 1, Fundamentals of Extrusion", The Materials Information Society, ASM International, 2000, United States, pp. 1-29.
ThomasNet.com, https:/www.thomasnet.com/articles/custom-manufacturing-fabricating/friction-stir-welding/ Feb. 10, 2011 (Year: 2011).
Trang et al., "Designing a Magnesium Alloy with High Strength and High Formability", Nature Communications, 2018, United Kingdom, 6 pages.
Whalen et al., "High Ductility Aluminum Alloy Made from Powder by Friction Extrusion", Materalia 6 (2019) 100260, Netherlands, 6 pages.
Whalen et al., U.S. Appl. No. 15/694,565, filed Sep. 1, 2017, titled "System and Process for Joining Dissimilar Materials and Solid-State Interocking Joint with Intermetallic Interface Formed Thereby", 69 pages.
Zhang et al., "Numerical Studies on Effect of Axial Pressure in Friction Stir Welding", (2007) Science and Technology of Welding and Joining, vol. 12, No. 3, United Kingdom, pp. 226-248.
WO PCT/US2023/015228 Search Rpt, dated Jun. 15, 2023, Battelle Memorial Institute.
WO PCT/US2023/015228 Written Opin, dated Jun. 15, 2023, Battelle Memorial Institute.

SHEAR-ASSISTED EXTRUSION ASSEMBLIES AND METHODS

CROSS REFERENCE TO RELATED APPLICATION

This application claims priority to and the benefit of U.S. Provisional Patent Application Ser. No. 63/244,632 filed Sep. 15, 2021, entitled "Co-Extrusion/Cladding of Dissimilar AL Alloys Via Shear Assisted Processing and Extrusion", the entirety of which is incorporated by reference herein.

STATEMENT AS TO RIGHTS TO INVENTIONS MADE UNDER FEDERALLY-SPONSORED RESEARCH AND DEVELOPMENT

This invention was made with Government support under Contract DE-AC05-76RL01830 awarded by the U.S. Department of Energy. The Government has certain rights in the invention.

TECHNICAL FIELD

The present disclosure relates to extrusion assemblies and methods. Particular embodiments include shear-assisted extrusion assemblies and methods that can be used to create multi-metallic materials.

BACKGROUND

Co-extrusion via hydrostatic extrusion and indirect extrusion is either expensive or results in non-uniform material flow. Furthermore, elaborate billet fabrication steps, requirement of specific area ratio between core and the sleeve, difficulty in co-extruding 1100 and 7075Al, and billet preheating are typically employed to obtain desirable bonding at the interface. Thermal spray coatings are limited to thin coatings which might not be beneficial for long-term applications due to cracking and spallation, and explosive bonding has safety and material constraints.

A few research level solutions that can never be applied at a manufacturing scale are fabrication of bi-metallic laminates using equal channel angular pressing and/or high pressure torsion.

Therefore, for increased energy efficiency and reduced plant downtime due to repair, an alternate manufacturing approach is required to fabricate the multi-metallic tubes with relative ease and better interface properties.

SUMMARY

Shear-assisted extrusion assemblies are provided. The assemblies can include: a billet assembly containing a billet comprising a billet outer material and a billet inner material in at least one cross-section; a tool operably engaged with the billet; an extrudate receiving channel configured to receive extrudate from the tool, wherein the extrudate comprises extruded outer material and extruded inner material in at least one cross-section, the extruded outer material being the same material as the billet outer material, and the extruded inner material being the same as the billet inner material.

Methods for producing a multi-material shear-assisted extrudate are also provided. The methods can include: providing a billet comprising billet inner material and billet outer material; providing shear-assisted force to a tool operably engaged with the billet to form an extrudate comprising extruded inner material and extruded outer material wherein the extruded outer material is the same material as the billet outer material, and the extruded inner material being the same as the billet inner material.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

The present disclosure will be described with reference to FIGS. 1-28. The present disclosure provides assemblies and methods for creating a co-extruded multi-metallic extrudates that can be co-extruded in the form of tubes. The extrudates can include at least an extruded inner material within an extruded outer material. The inner material can be referred to as a core and the outer material can be referred to as a cladding or sleeve. In tube configurations, the inner material can be referred to as an inner layer and the outer material as an outer layer.

The materials (inner, outer, intermediate) that make up the extrudate can have distinct chemical and/or mechanical properties. For example, co-extrusion of 6061 (shell) and 7075 (core), 1100 (shell) and 7075 (core), and 1100 (shell) and 2024 (core) was performed to complete extrudates having commensurate outer and inner materials having sound bonding at the interface. Furthermore, thickness of the sleeve and core can be controlled via the area ratio of the constituent billet material. Multi-metallic tubes can be fabricated utilizing a tool that engages a mandrel.

The ShAPE process works in billet area ratio of ⅓ and ⅔, and also ½ and ½ leading to the tube thickness of ⅓ and ⅔, and ½ and ½, respectively. Based on the current observations, a much thinner core/sleeve, preferably having ¼ of the tube thickness is quite possible. Therefore, either a thicker or thinner coating can easily be fabricated. Temperature control of the process using the shear and friction parameters can provide for more flexible fabrication of multi-metallic components having significantly different flow stresses. Furthermore, multi-metallic extrudate tubes exhibiting variable thicknesses can be fabricated by controlling the billet stack with minimal effort in billet fabrication. This allows for joining the b metallic tubes to other structures so that easily weldable material of necessary thickness is the sleeve. Difficult to extrude material combination such as 1100 and 7075/2024 Al can easily be co-extruded.

Furthermore, these multi-metallic extrudates, having gone through high temperature severe plastic deformation, can be aged without solutionizing or annealing heat treatments, thereby thermal stresses and the subsequent dimensional instability can be avoided and/or grain growth minimized.

Figure 1:
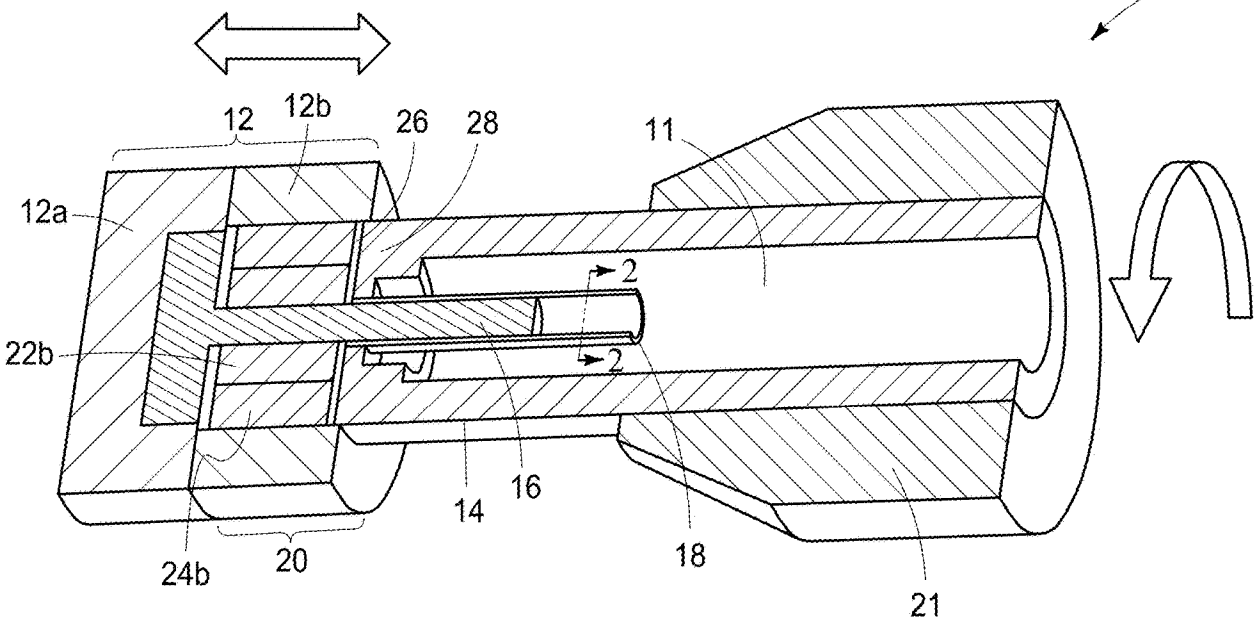
FIG. 1 is an example depiction of a portion of a shear-assisted extrusion assembly according to an embodiment of the disclosure.

Referring to FIG. 1, a portion of an example shear-assisted extrusion apparatus 10 is shown that includes a billet holder assembly 12 that comprises and container base 12*a* and a container ring 12*b*. Within assembly 12 is billet 20. Billet 20 comprises at least two materials, but may contain additional materials in different alignments. In this configuration, billet material 20 comprises at least a billet inner material 22*b* and a billet outer material 24*b*. As an example, materials 22*b* and 24*b* will be different materials as noted herein. The materials may differ in chemical and/or mechanical properties. The materials may also have different dimensions. For example, the thickness ratio of the materials as shown appear to be the same. Other thickness ratios can be utilized with the outer material being less or greater thickness than the inner material.

Tool 14 can be retained within tool holder 21 and operably engaged with billet material 20 to create a high shear region 26 at die face 28. As shown, a rotational force and axial force is applied to die face 28 of tool 14. The axial force may be applied from the tool upon the feed material; alternatively, the axial force may be applied from the feed material upon the tool. In accordance with example implementations, the shear assisted extrusion process will provide an extrudate 18. Mandrel 16 can be anchored in billet holder assembly 12 and extend through billet material 20 and die face 28 to extrudate receiving channel 11.

This application is related to U.S. Continuation-In-Part patent application Ser. No. 17/473,178 filed Sep. 13, 2021, entitled "Devices and Methods for Performing Shear-Assisted Extrusion and Extrusion Processes". the entirety of which is hereby incorporated by reference herein.

Figure 2:
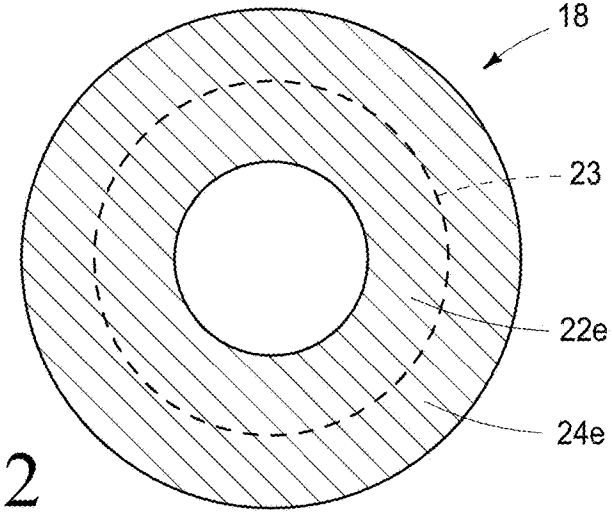
FIG. 2 is a cross-section of an extrudate or extruded material according to an embodiment of the disclosure.

Referring to FIG. 2, extrudate 18 can comprise at least extruded inner material 22*e* and extruded outer material 24*e*. These extruded materials (22*e*/24*e*) can be the same as billet materials (22*b*/24*b*) and have substantially the same ratio of thickness (e.g., area ratio of ⅓ and ⅔, and also ½ and ½ leading to the tube thickness of ⅓ and ⅔, and ½ and ½, respectively). The extruded materials can be bonded at interface 23 while the billet materials are not bonded.

Referring to FIGS. 3-12, various combinations of billet material configurations as well as extruded material configurations are shown. For example, FIGS. 3-7 demonstrate inner billet material 22*b* and outer billet material 24*b* bounded by billet material 40*b*. When shear-assisted extruded, extruded inner material 22*e* and outer extruded outer material 24*e* are bounded by extruded material 40*e*. This extruded material can have bonding interfaces between the inner 22*e* and outer 24*e* materials as well as between the outer 24*e* and extruded material 40*e* and/or the inner 22*e* and extruded material 40*e*.

Referring to FIGS. 8-12 a summary of example billet and extruded material configurations are shown. This summary is not provided to be exhaustive, just as an example. Accordingly, the billet material and the extrudate can include intermediate materials 90*b*/90*e*. These intermediate materials can include multiple materials themselves. Thus, the materials can include multiple layers in at least one cross-section. Additionally, with reference to FIGS. 10 and 11, inner and/or outer materials can extend to complete and be the same material as bounding materials. Accordingly, the inner or outer materials can be the same as bounding materials (e.g., 40). Also, with reference to FIG. 12, multiple inner and multiple outer materials can be provide as shown. Accordingly, outer materials can include distinct materials 24 and 120. Additionally, inner materials can include distinct materials 22 and 122. As the depiction provides, the abutment of these materials need not align.

Accordingly, billet containing assembly 12 containing a billet that includes a billet outer material 22*b* and a billet inner material 24*b* in at least one cross-section. The billet 20 can also include a billet intermediate material 90*b* between billet inner material 22*b* and billet outer material 24*b* in the at least one cross-section. The assembly can include mandrel 16 extending from billet containing assembly 12 to tool 14. Mandrel 16 can extend through an opening in die face 28 of the tool 14. Billet material 20 can also include a billet boundary material 40*b* directly adjacent and/or lateral of either billet inner material 22*b* or outer material 24*b*. the billet boundary material is the same material as the billet outer material. Billet boundary material 40*b* can be a different material than either or both of the billet inner material 22*b* or outer material 24*b*. In at least one cross-section the thickness of one or more of the inner 22*e*, outer 24*e*, and/or intermediate 90*b* billet materials is different. Each material thickness can be as low as a $10^{th}$ of the thickness of the material directly adjacent thereto. In billet container assembly 12, the billet materials can be unbound.

The extrudate 18 can also include extruded intermediate material 90*e* between extruded outer material 24*e* and extruded inner material 22*e* in the at least one cross-section.

In accordance with the above assemblies, the methods can include a billet intermediate material 90*b* between the billet inner material 22*b* and billet outer material 24*b*. Billet intermediate material 90*b* can be a single material or multiple different materials. Inner 22*b* and outer 24*b* billet material can be about the same thickness in at least one cross-section. Extruded inner 22*e* and outer 24*e* materials can be about the same thickness in at least one cross-section. Inner billet material 22*b* can be 1/10 to 9/10 the thickness of outer 24*b* billet material. Extruded inner material 22*e* can be 1/10 to 9/10 of the thickness of extruded outer billet material 24*e*. The extruded materials define bonded interfaces between different and previously unbound billet materials.

As an example method with reference to Table 1 below, multi-metallic extrudates were prepared. These parameters are not limiting and ranges of rotational speed as well as advance rate can be utilized.

TABLE 1

Summary of example shear-assisted processing conditions employed to fabricate the multi-material extrudates.

| Material combination | Die rotational speed (RPM) | Die advance rate (mm/min) | Tube length, mm |
|---|---|---|---|
| 1100 (24) and 7050 (22) Al | 40 | 60 | 1960 |
| 1100 (24) and 2024 (22) Al | 45 | | 1830 |

The extruded tubes were sectioned for various microscopy and mechanical property characterizations in as-extruded condition. For optical and scanning electron microscopy (SEM) analysis, the tubes were sectioned along both longitudinal and transverse cross-sections. The cut samples were mounted in an epoxy, polished to a surface finish of 0.05 μm using colloidal silica suspension, and etched using Keller's reagent. Both stereo and light microscopy (in bright field mode) analyses of the samples were carried to analyze the tube quality and interface characteristics. The samples were repolished to 0.05 μm surface finish for SEM and energy-dispersive X-ray spectroscopy (EDS) analysis. SEM in back scattered electron (BSE) mode and EDS analyses of the cladded tubes and the interface between 1100/7075 Al, and 1100/2024 Al were completed using the FEI Quanta 3D field emission gun dual beam FIB/SEM. Vickers hardness measurements in as-extruded was carried out using Clark Microhardness tester CM-700AT and five indents per sample was done. Tensile testing of 127 mm (5") long tubes was carried out in accordance with ASTM-B557 standard. All the results and discussion are presented in the next section.

Figure 3:
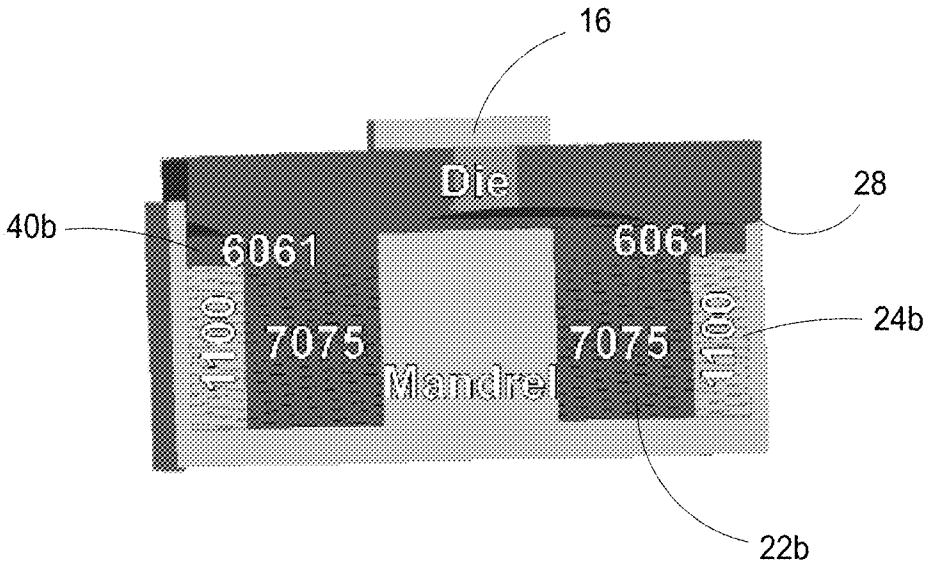
FIG. 3 is an example configuration of a portion of a shear-assisted assembly according to an embodiment of the disclosure.
Figure 4:
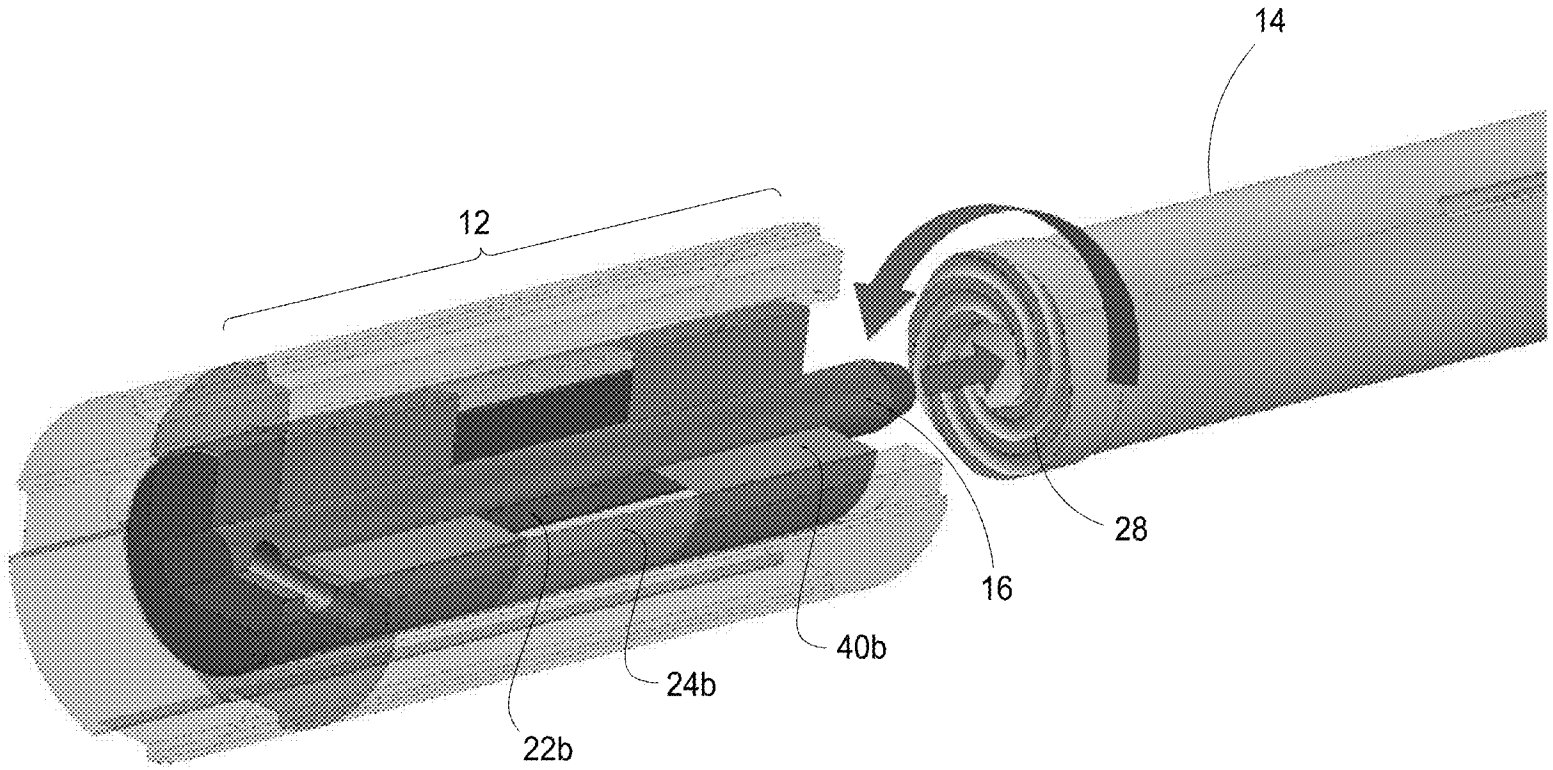
FIG. 4 depicts another configuration of a portion of a shear-assisted extrusion assembly according to an embodiment of the disclosure.
Figure 5:
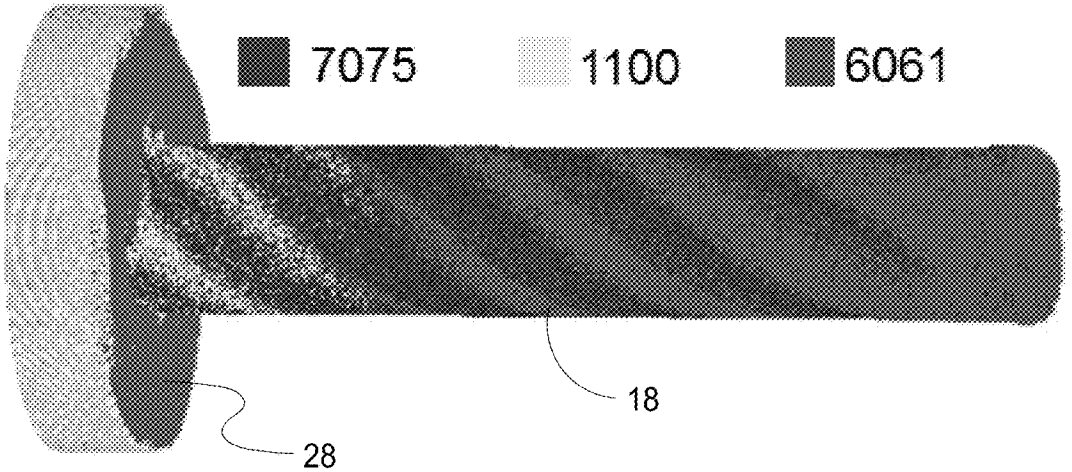
FIG. 5 is a depiction of a shear-assisted extrudate according to an embodiment of the disclosure.
Figure 7:
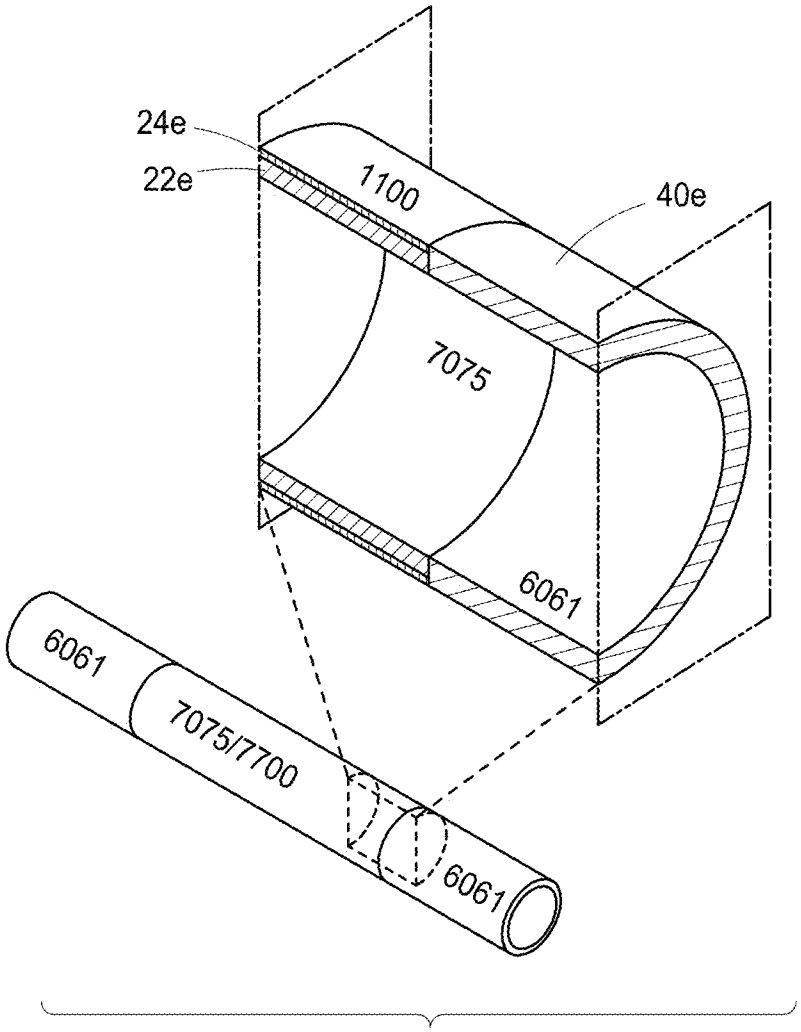
FIG. 7 is an extrudate material according to an embodiment of the disclosure.
Figure 6:
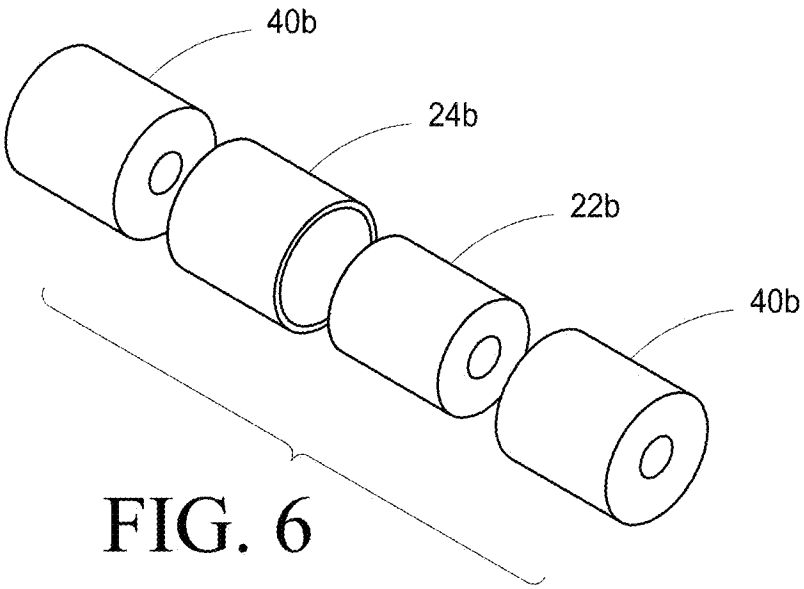
FIG. 6 is an exploded view of a billet configuration for use with shear-assisted extrusion assemblies according to an embodiment of the disclosure.
Figure 8:
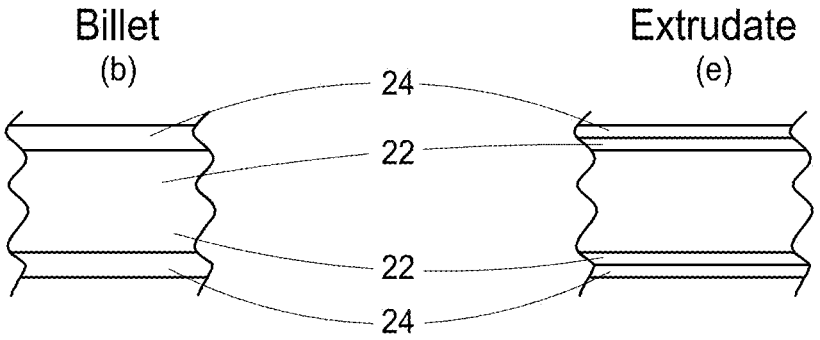
FIGS. 8-12 are example billet configurations and commensurate extrudate materials obtained utilizing the example billet configurations according to embodiments of the disclosure.
Figure 9:
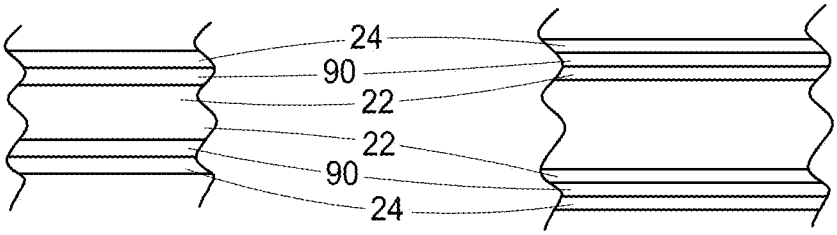
Figure 10:
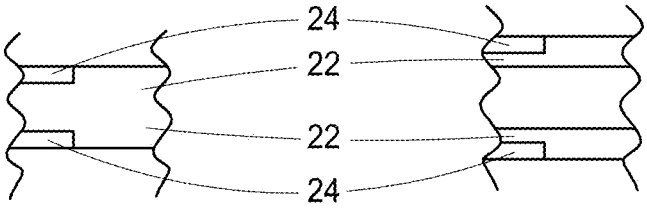
Figure 11:
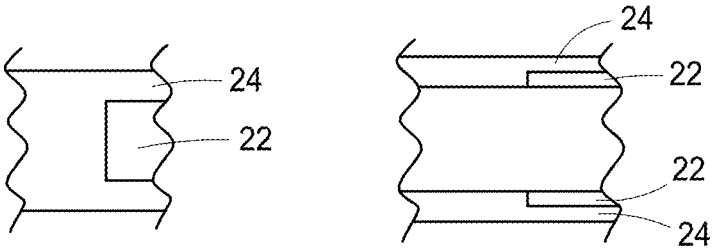
Figure 12:
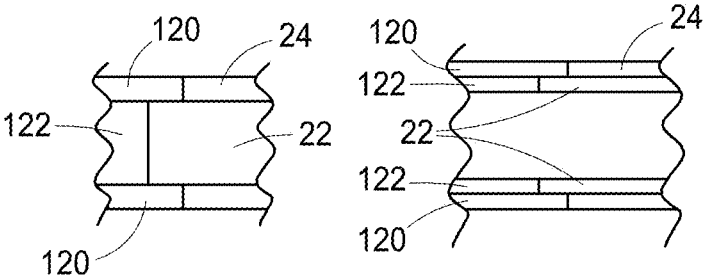

Referring to FIG. 3, and with reference to Table 2, tensile properties of multi-metallic extrudates having differing inner and outer thickness ratios are shown.

TABLE 2

| Material combinations | YS (MPa) | UTS (MPa) | EI % |
|---|---|---|---|
| 6061/7075 Al (½ and ½) | 175 | 252 | 13 |
| 6061/7075 Al (⅔ and ⅓) | 168 | 224 | 8.5 |
| 1100/7075 Al | 132 | 219 | 9 |
| 1100/2024 Al | 116 | 198 | 11.5 |

Figure 13:
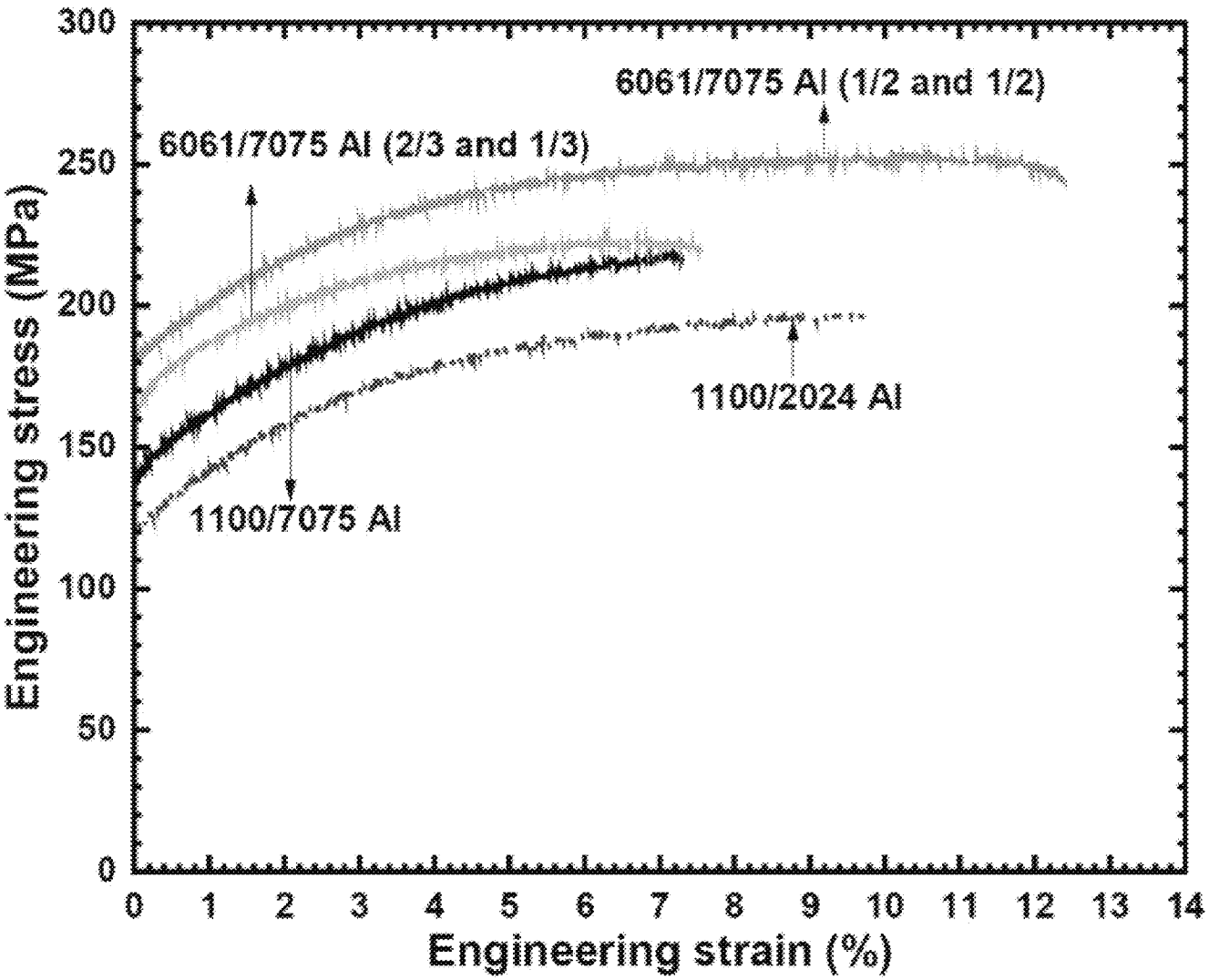
FIG. 13 is a depiction of data of extruded material according to an embodiment of the disclosure.
Figure 14:
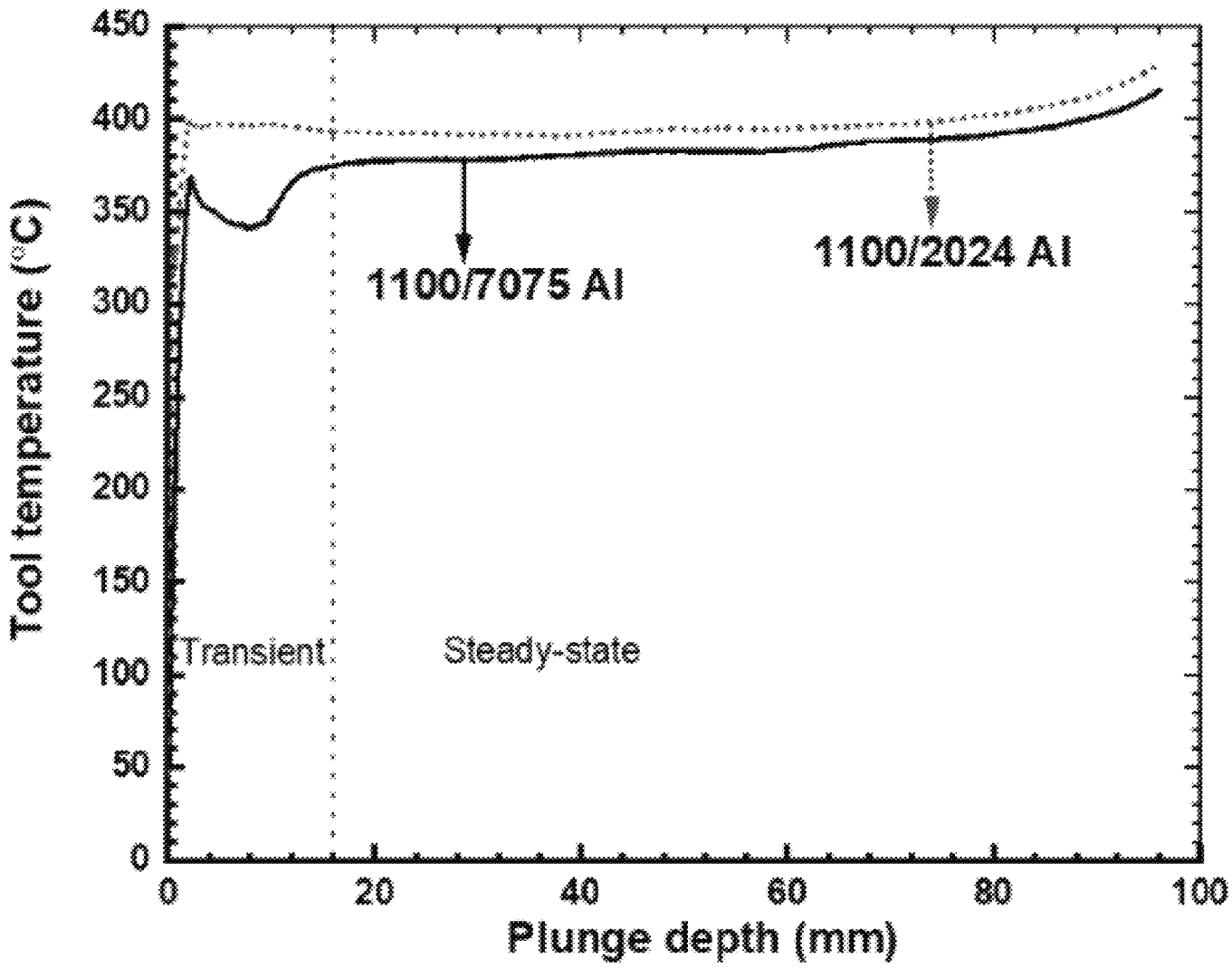
FIG. 14 is a depiction of the operating conditions of a shear-assisted extrusion assembly utilizing differing materials according to an embodiment of the disclosure.
Figure 15:
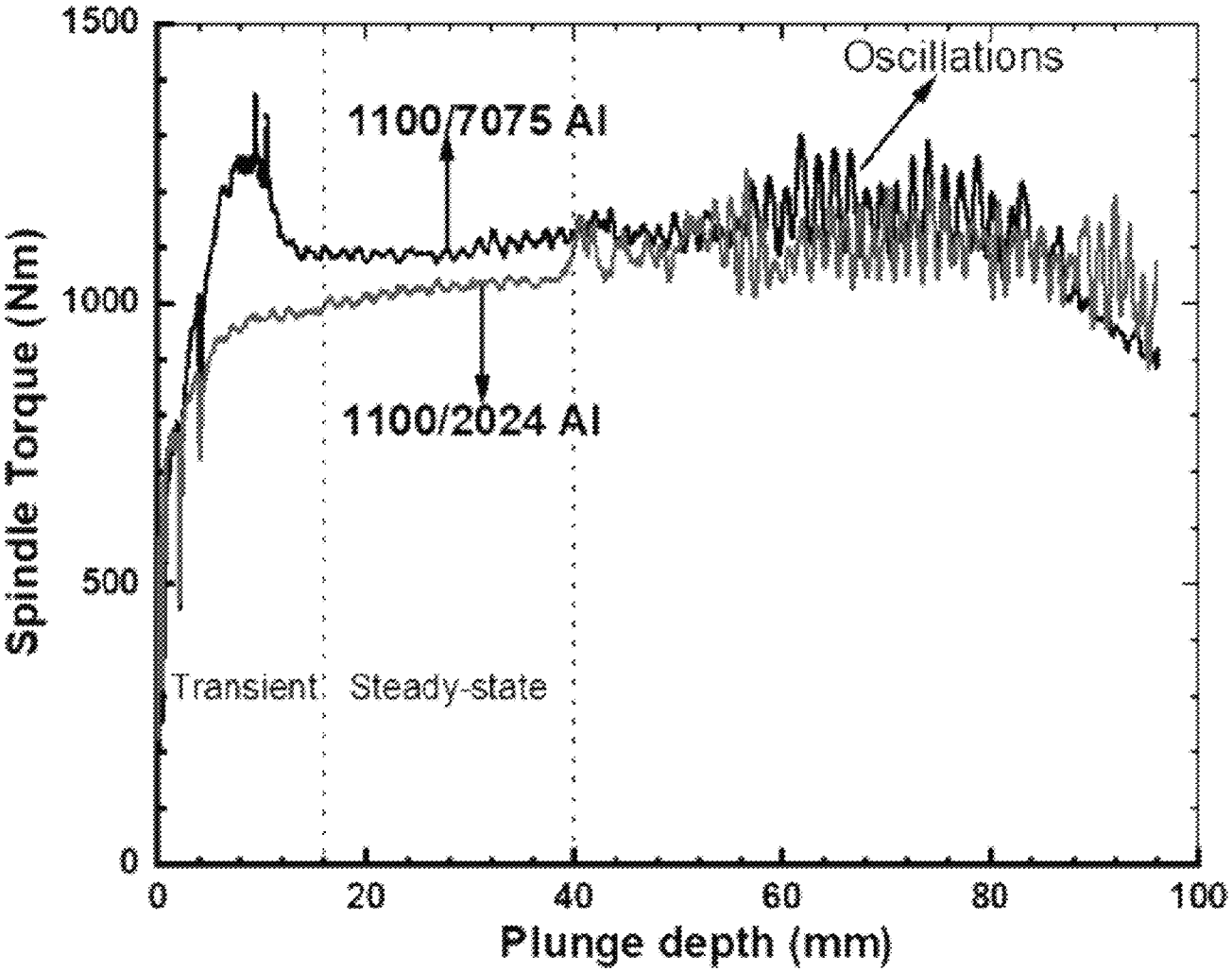
FIG. 15 is another example of shear-assisted extrusion assembly parameters according to an embodiment of the disclosure.

The measured tool temperature (° C.) and the spindle torque (Nm) as a function of plunge depth for both the extrusions is presented in FIGS. 13 and 14, respectively. What can be considered a long steady-state temperature region was followed by an initial transient temperature region.

Steady-state temperatures in 1100/7075 Al and 1100/2024 Al were about 380 and 390° C., respectively, mainly due to slightly lower rotational speed in the former extrusion. An initial transition in spindle torque was also noted (FIG. 15) followed by an almost steady-state. However, beyond plunge depth of ~40 mm, oscillation in torque was observed. Exact origin of these oscillations is not known; however, a possible hypothesis could be based on the sticking characteristics of 1100 Al exhibits during thermomechanical processing. During ShAPE process, 1100 Al sticks to the extrusion die and at higher force the material slips, then the continuation of this process would result in torque oscillations, as noted in FIG. 15.

Figure 16:
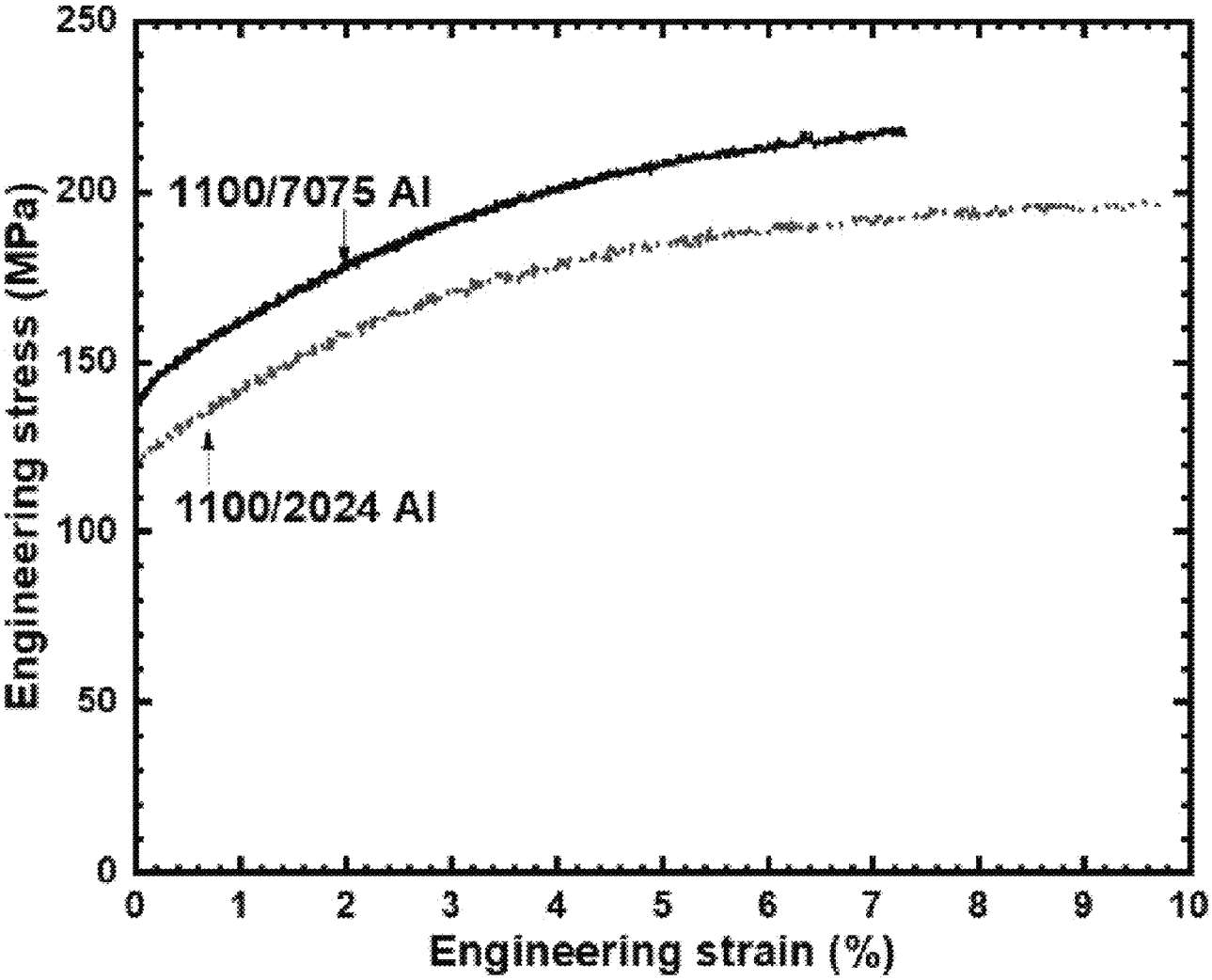
FIG. 16 is an example of co-metallic extruded material properties according to an embodiment of the disclosure.
Figure 17A:
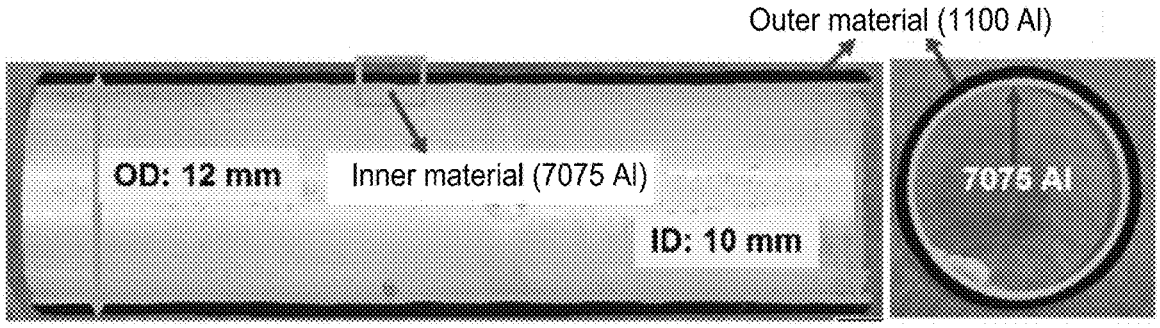
FIGS. 17A-17E are depictions of multi-metallic extruded material according to an embodiment of the disclosure.
Figure 17B:
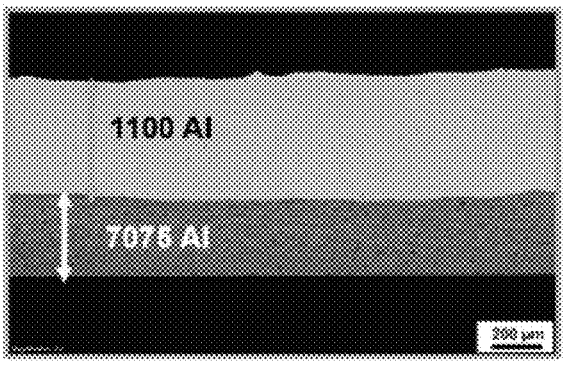
Figure 17C:
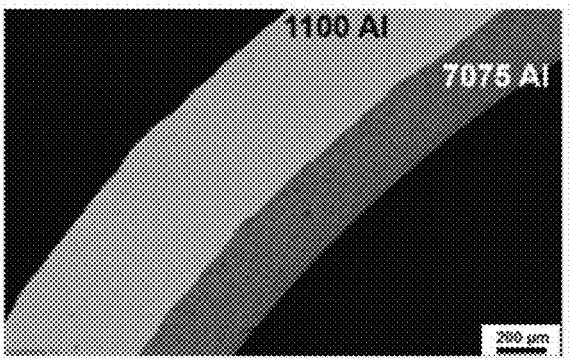
Figure 17D:
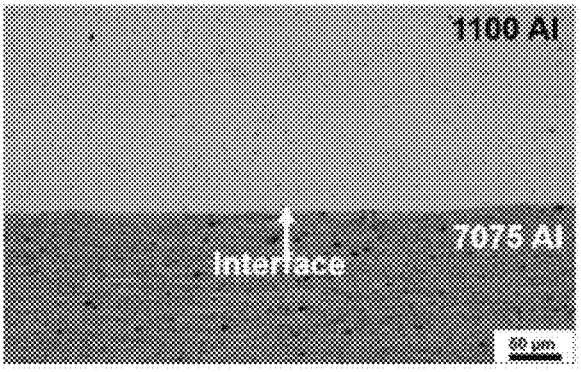
Figure 17E:
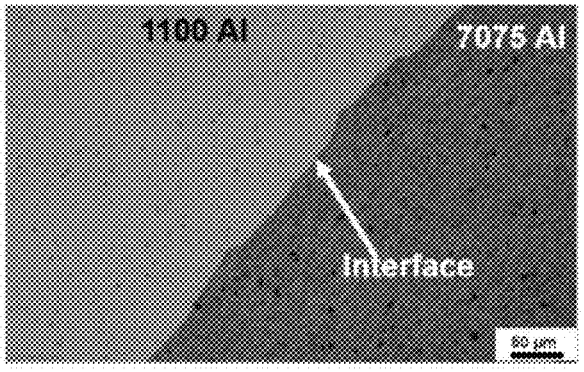

Referring next to FIG. 16, a comparison of coextruded multi-metallics is shown. Additional analysis of coextruded materials have been performed using Stereo and light microscopy of cladded 1100 on 7075 Al and 1100 on 2024 Al are presented in FIGS. 17A-17E and 20A-20E respectively. FIGS. 17A-17B and 20A-20B represent the macroview of both longitudinal and transverse cross-sections for cladded 1100/7075 Al and 1100/2024 Al, respectively. The cladded outer layer (1100 Al) was continuously present along the tube (dark region) in all the conditions and cross-sections analyzed. The bright inner region in FIGS. 17A-17B and 20A-20B correspond to 7075 Al and 2024 Al, respectively. Thickness of tubes measured on the transverse cross-section for 1100/7075 and 1100/2024 are 0.92±0.05 mm and 0.97±0.14 mm, respectively. As noted, tube thickness in 1100/2024 Al was higher than 1 mm in certain locations as compared with 1100/7075 Al. The thickness of the outer and inner layers for 1100/7075 Al are 0.6±01 and 0.36±0.06 mm, respectively, and thickness for the outer and inner layers for 1100/2024 Al are 0.57±0.1 and 0.38±0.03 mm, respectively. In both the tubes, the 1100 Al outer layer exhibited larger thickness than the expected 0.5 mm based on the billet area. The light microscopy images are presented in FIGS. 17B-17E and 20B-20E. Both outer and inner layers of the tube for both cladded configurations did not have any processing flaws. Furthermore, higher magnification analysis of the interface region shows that the interface in both the conditions is defect-free and wavy in nature. SEM-BSE and SEM-EDS analyses of 1100/7075 and 1100/2024 Al cladded tubes are presented in FIGS. 18A-18C and 21A-21C, respectively. Interface region between 1100/7075 and 1100/2024 Al cladded tubes is marked with a solid arrow. For the most part, interface region did not exhibit discontinuities except for a few micro-cracks as marked by the dotted arrow in FIG. 18A. Therefore, the interface region was metallurgically bonded in both the conditions as clearly observed in FIGS. 18B and 21B. Furthermore, presence of second phases is noted in both 7075 and 2024 Al alloys. Results of SEM-EDS line scan analysis of 1100/7075 Al and 1100/

Figure 18B:
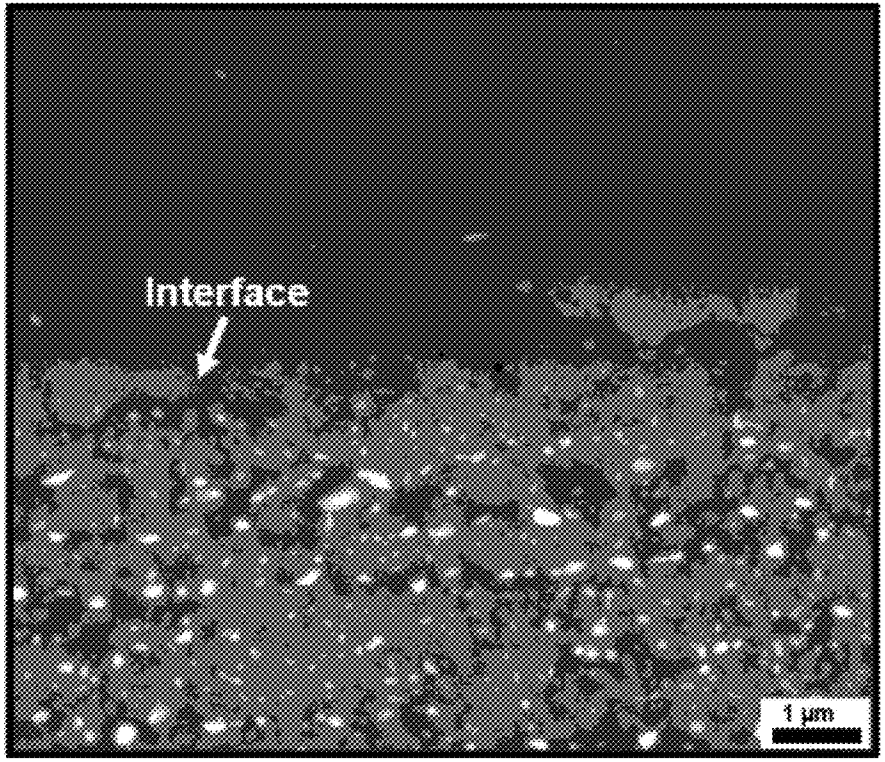
FIGS. 18A-18C are depictions of interfacial portions of multi-metallic extruded materials according to an embodiment of the disclosure.
Figure 18A:
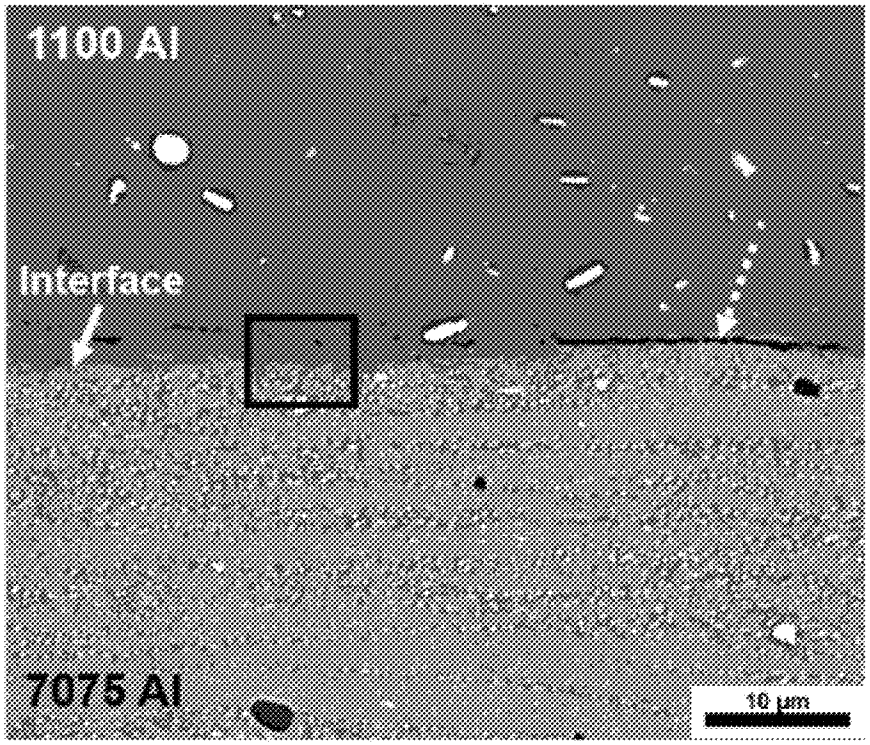
Figure 18C:
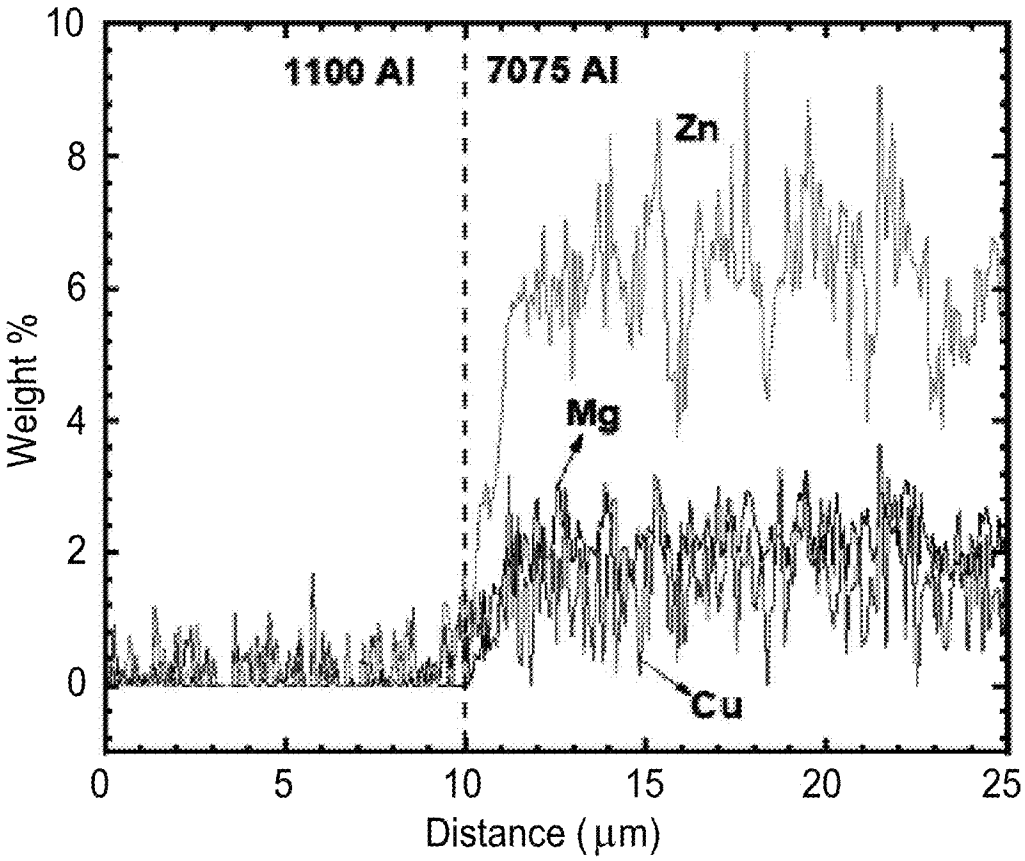
Figure 19A:
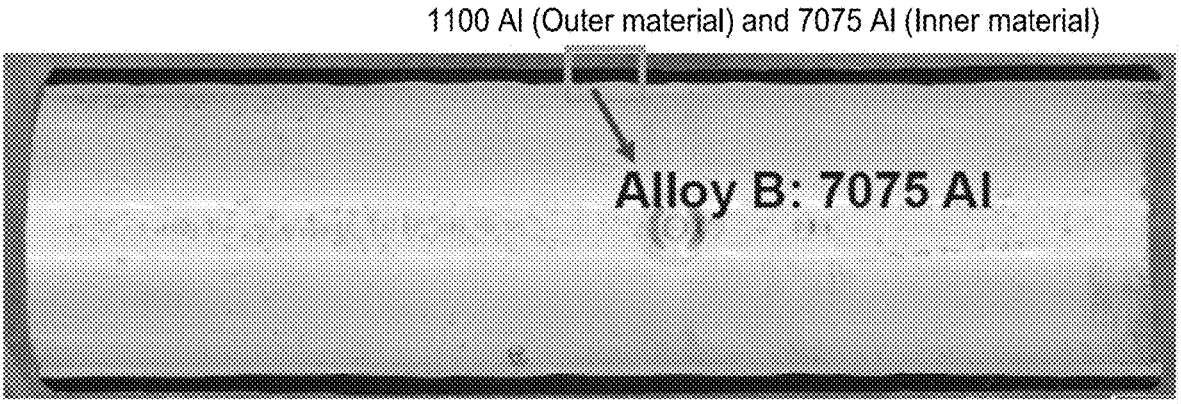
FIGS. 19A-19D are depictions of multi-metallic extruded materials according to an embodiment of the disclosure.
Figure 19B:
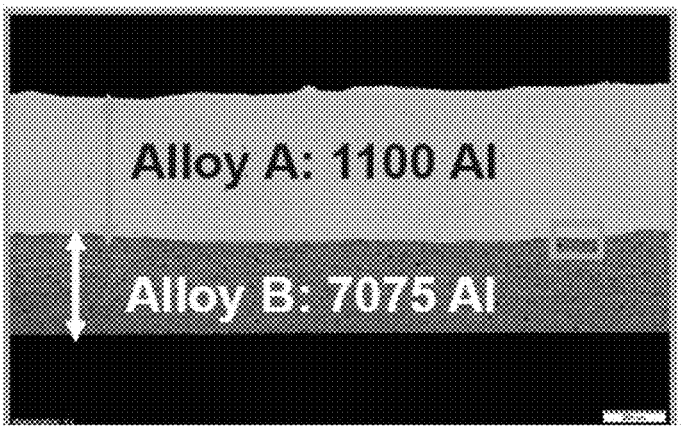
Figure 19C:
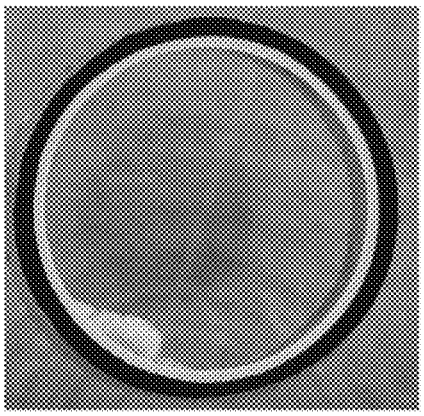
Figure 19D:
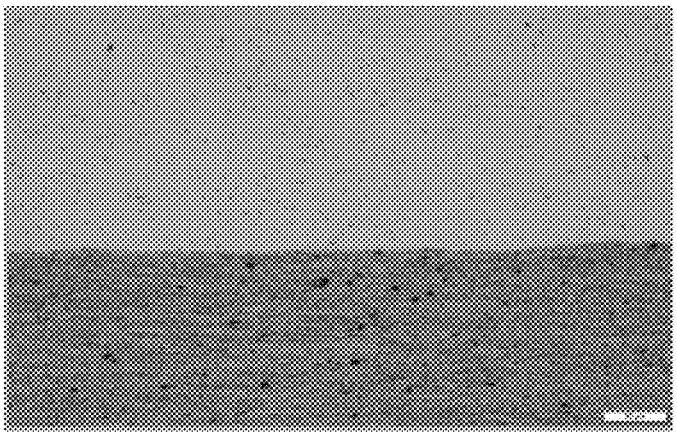
Figure 20A:
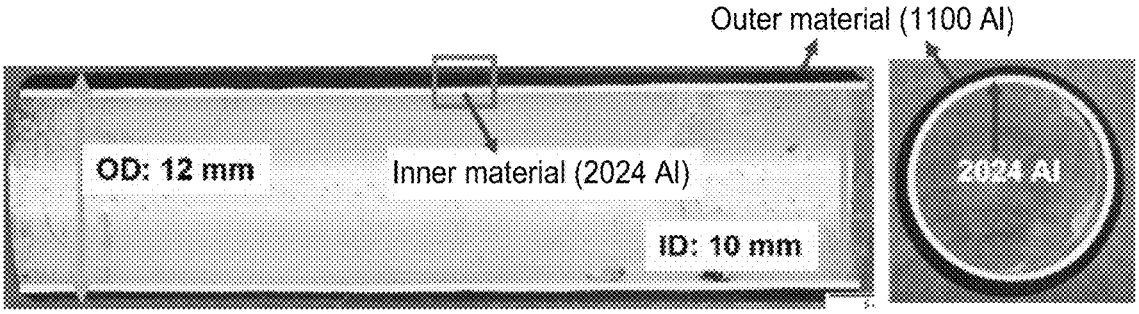
FIGS. 20A-20E are depictions of interfacial multi-metallic extruded materials according to an embodiment of the disclosure.
Figure 20B:
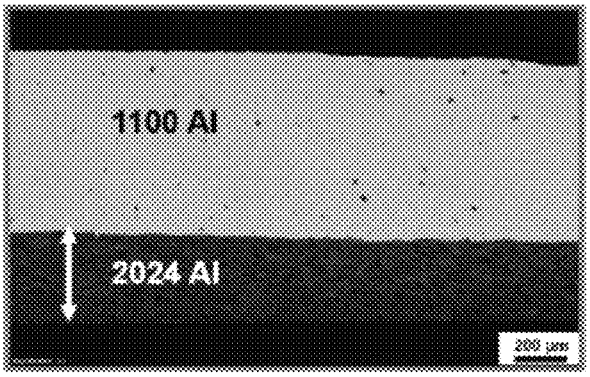
Figure 20C:
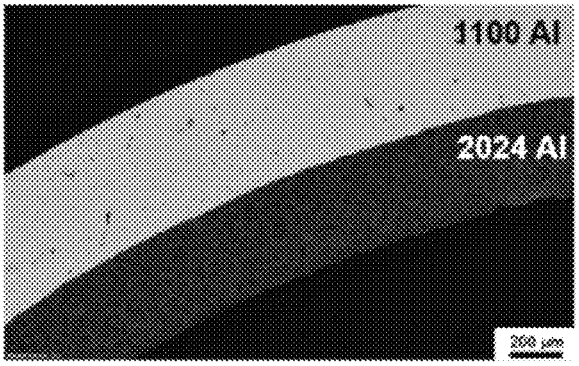
Figure 20D:
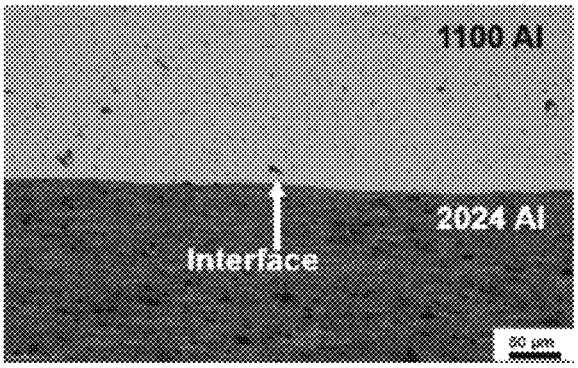
Figure 20E:
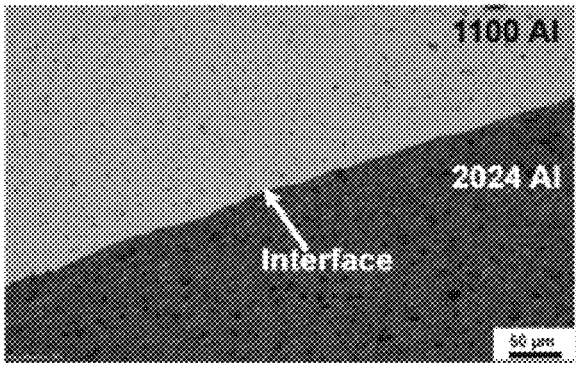
Figure 21B:
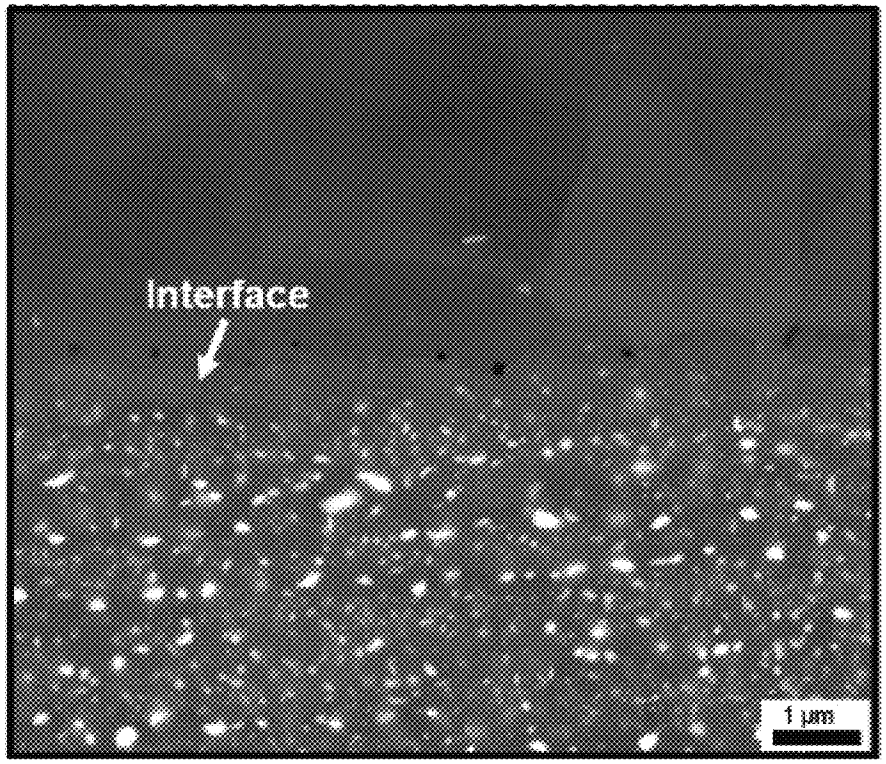
FIGS. 21A-21C are depictions of portions of multi-metallic extruded materials according to an embodiment of the disclosure.
Figure 21A:
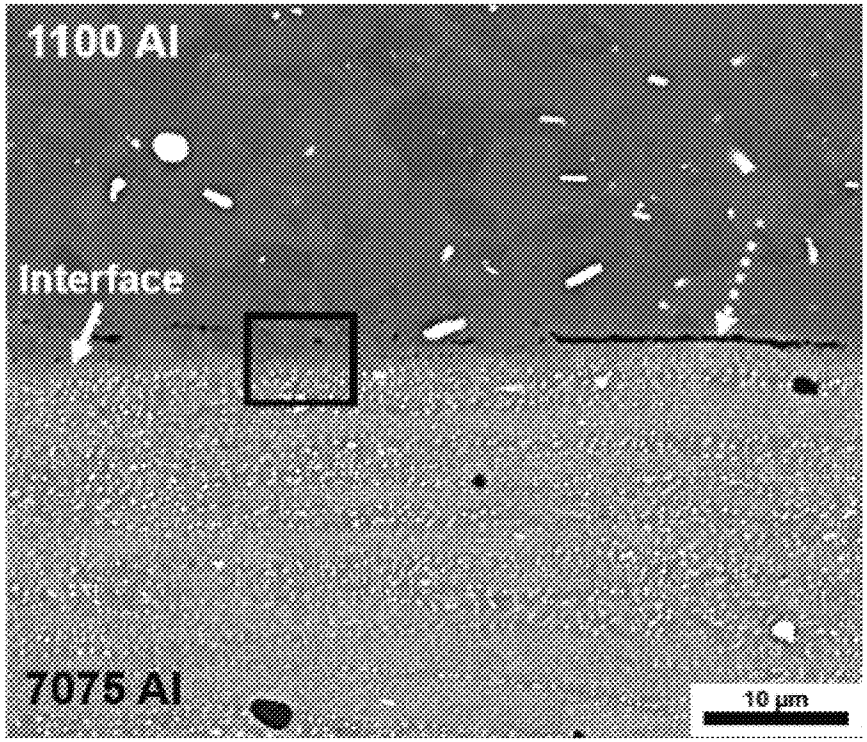
Figure 21C:
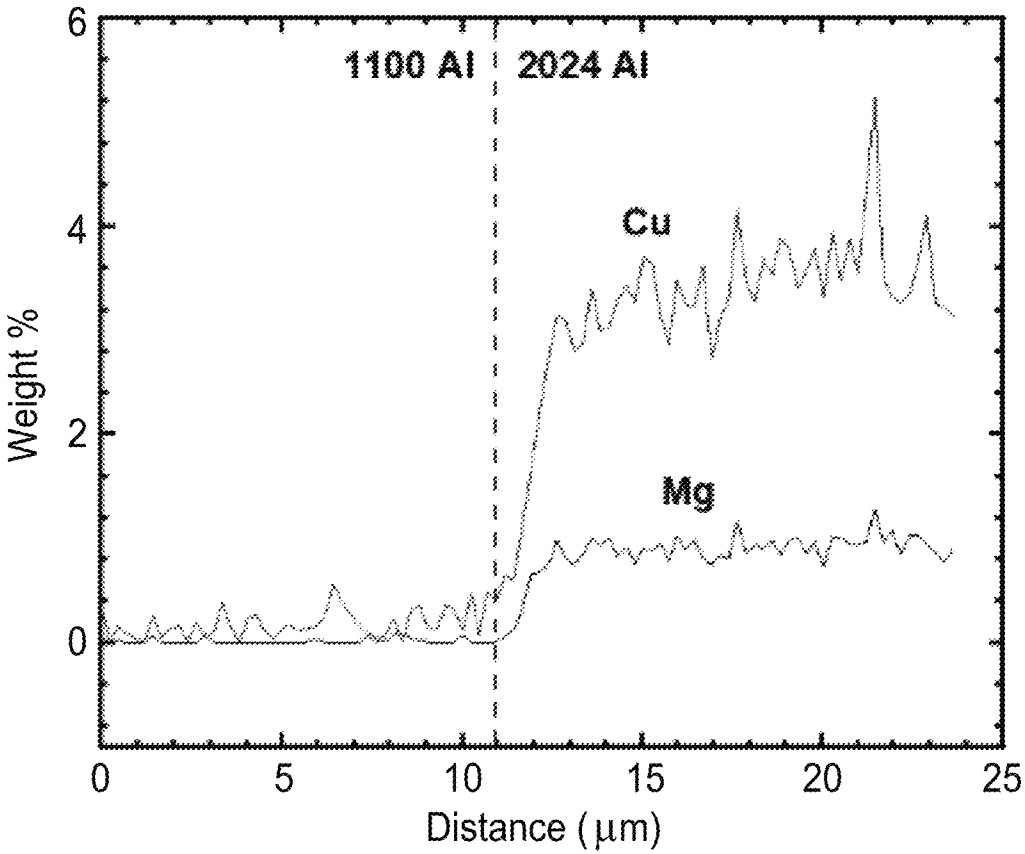
Figure 22A:
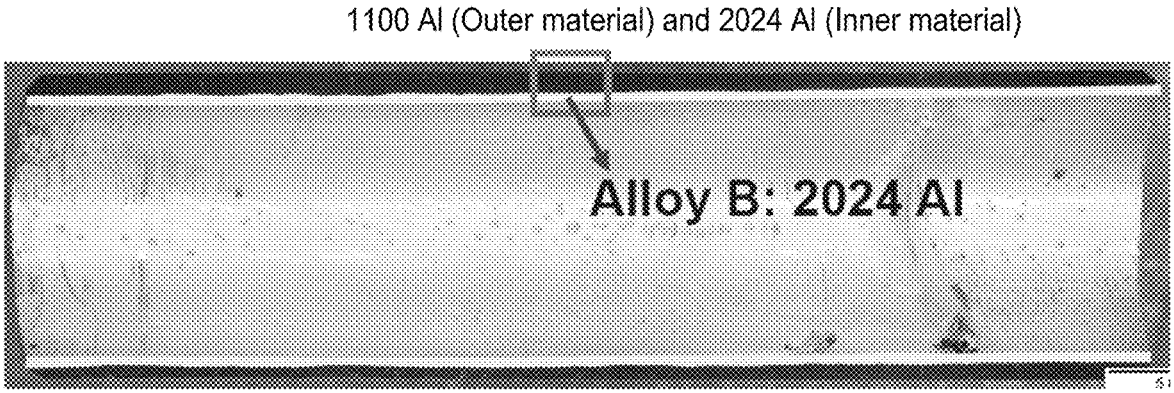
FIGS. 22A-22D are depictions of multi-metallic extruded materials according to an embodiment of the disclosure.
Figure 22B:
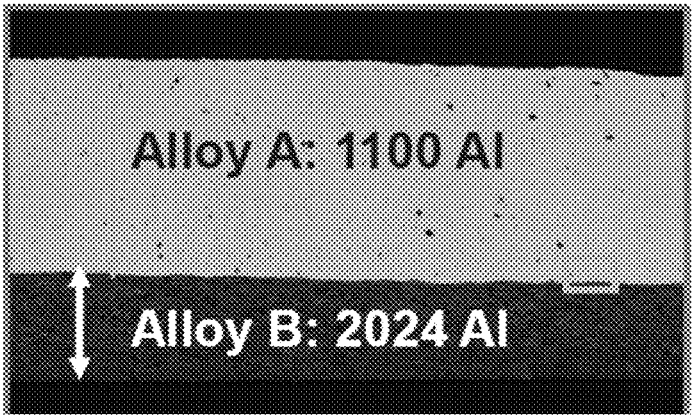
Figure 22C:
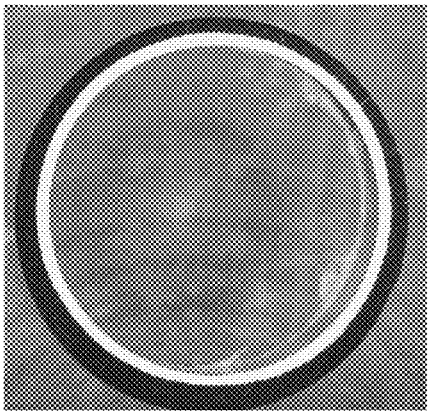
Figure 22D:
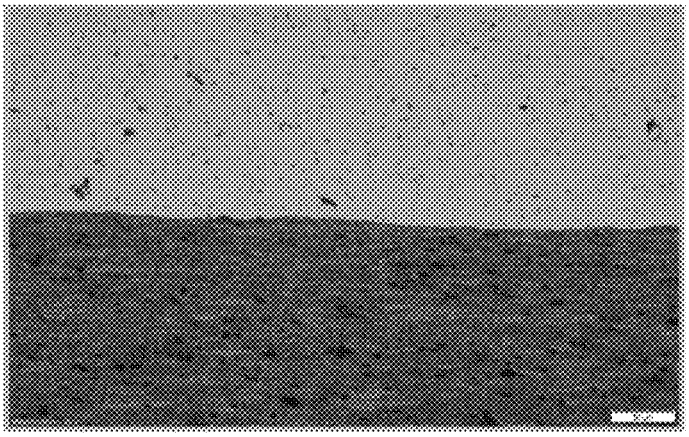

2024 Al are presented in FIGS. 18C and 21C, respectively. As expected, Zn and Cu content increased across the cladded interface from 1100 Al into the 7075 and 2024 Al, respectively. Additional data are provided in Tables 3-4 below regarding hardness and tensile strength of the multi-metallic materials.

TABLE 3

Hardness summary in as-extruded condition for 1100 and 7075 Al and 1100 and 2024 Al cladded tubes

| | Material identification | Hardness (HV0.1) |
|---|---|---|
| 1100/7075 Al | 1100 Al | 20.2 ± 0.2 |
| | 7075 Al | 83.3 ± 3.0 |
| 1100/2024 Al | 2024 Al | 68.0 ± 1.0 |
| | 1100 Al | 21.0 ± 0.3 |

TABLE 4

Tensile properties Summary of the cladded Al tubes.

| | YS (MPa) | UTS (MPa) | El. % |
|---|---|---|---|
| 1100/7075 Al | 135 ± 3.5 | 213 ± 5 | 6.4 ± 1.4 |
| 1100/2024 Al | 117 ± 5.4 | 199 ± 4 | 10.6 ± 1.1 |

Overall, the presence of metallurgically bonded interface obtains cladded tubes with good structural integrity.

Referring next to FIGS. 19A-19D and 22A-22D, inner and outer materials having similar cross-section area are provided and metallurgical bonding was determined to be present in both cases of 1100 outer and 7075 or 2024 inner.

Figure 23A:
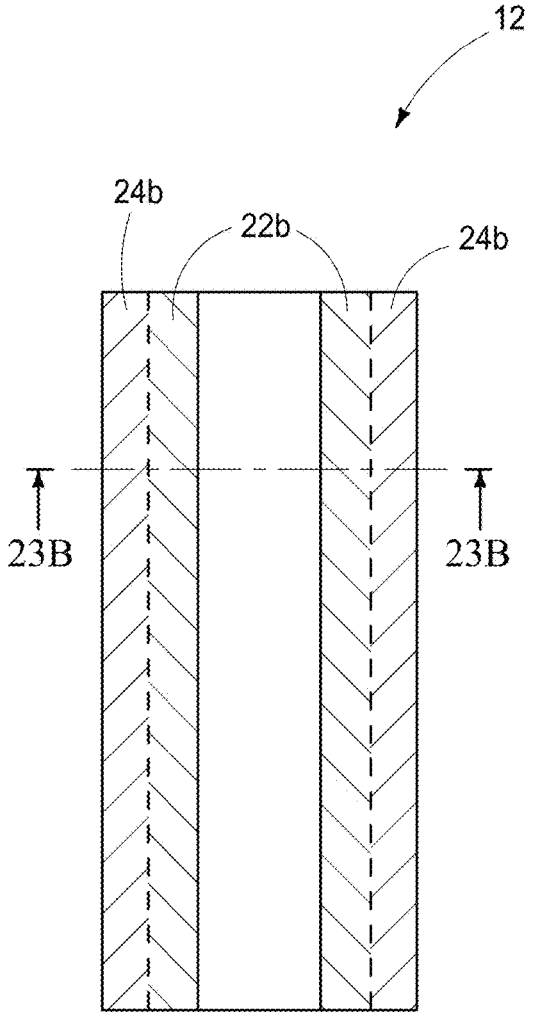
FIGS. 23A-23B are depictions of a billet configuration according to an embodiment of the disclosure.
Figure 23B:
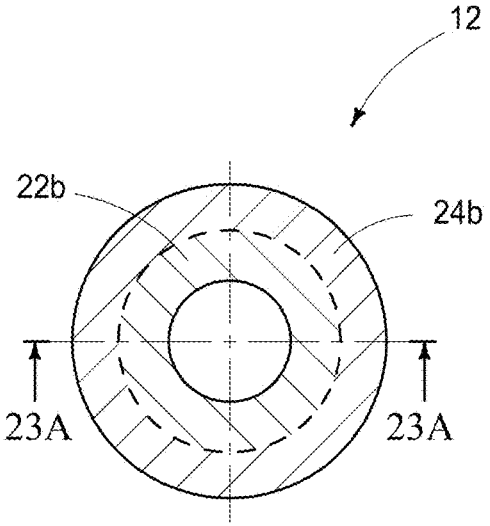
Figure 24A:
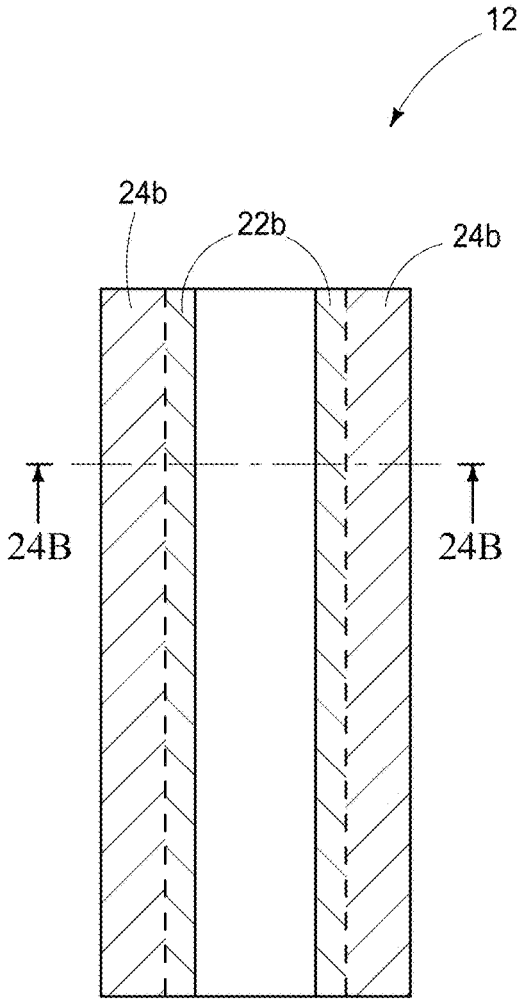
FIGS. 24A-24B are depictions of billet configurations according to an embodiment of the disclosure.
Figure 24B:
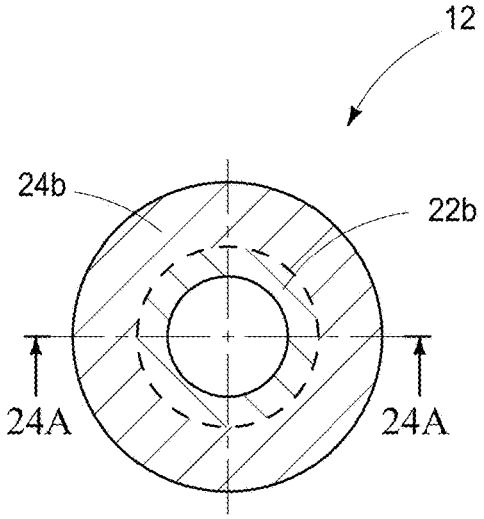
Figure 25A:
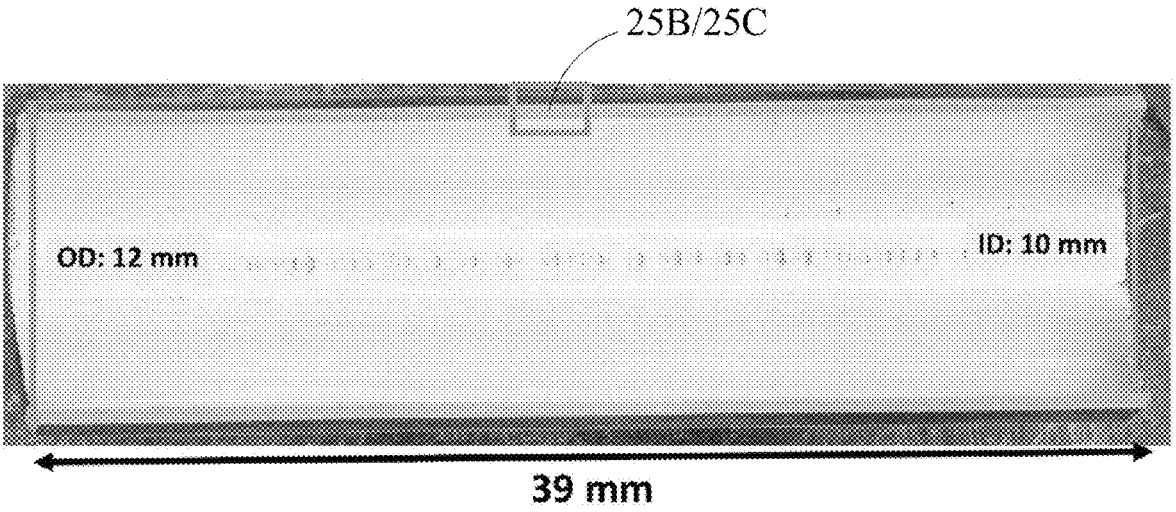
FIGS. 25A-25C are depictions of multi-metallic extruded materials according to an embodiment of the disclosure.
Figure 25B:
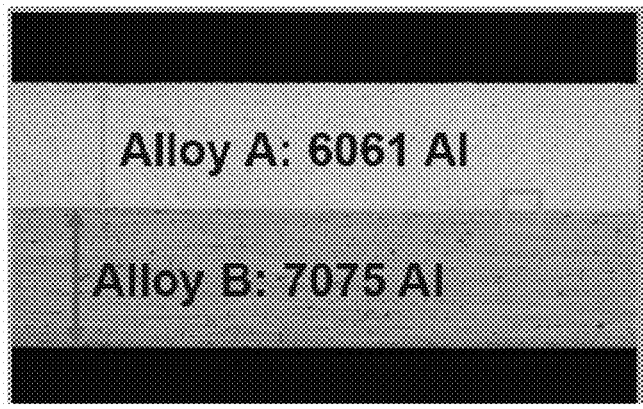
Figure 25C:
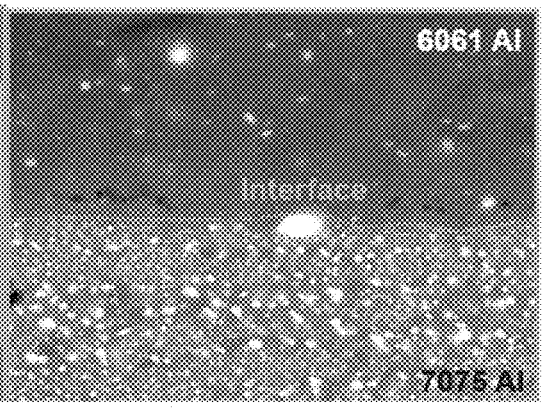
Figure 26A:
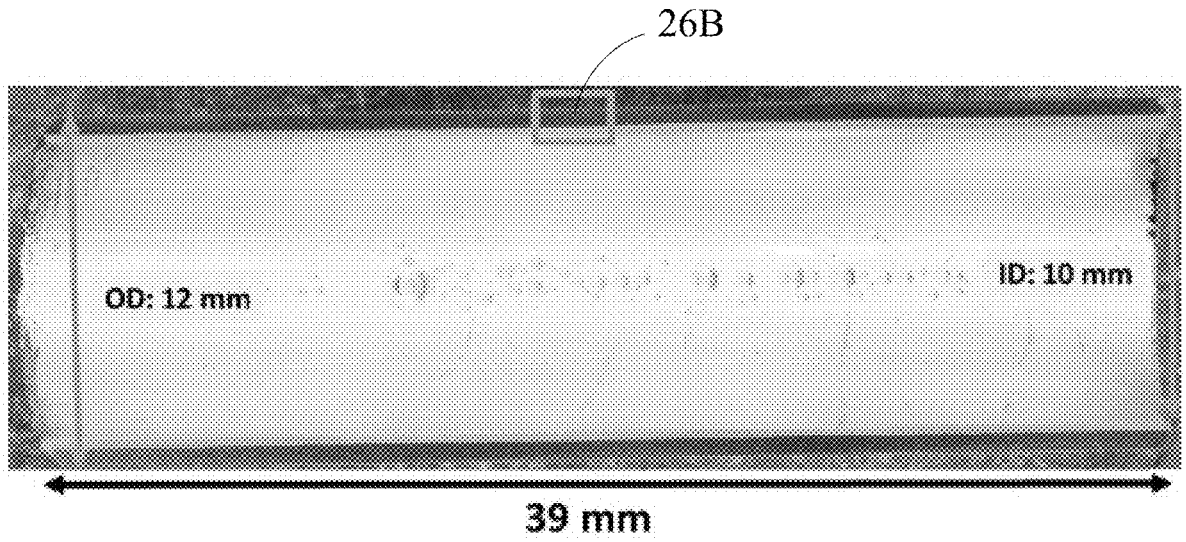
FIGS. 26A-26B are depictions of multi-metallic extruded materials according to an embodiment of the disclosure.
Figure 26B:
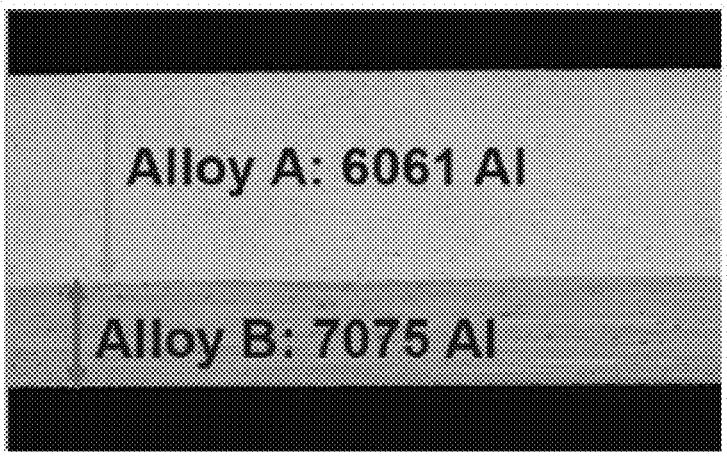
Figure 27:
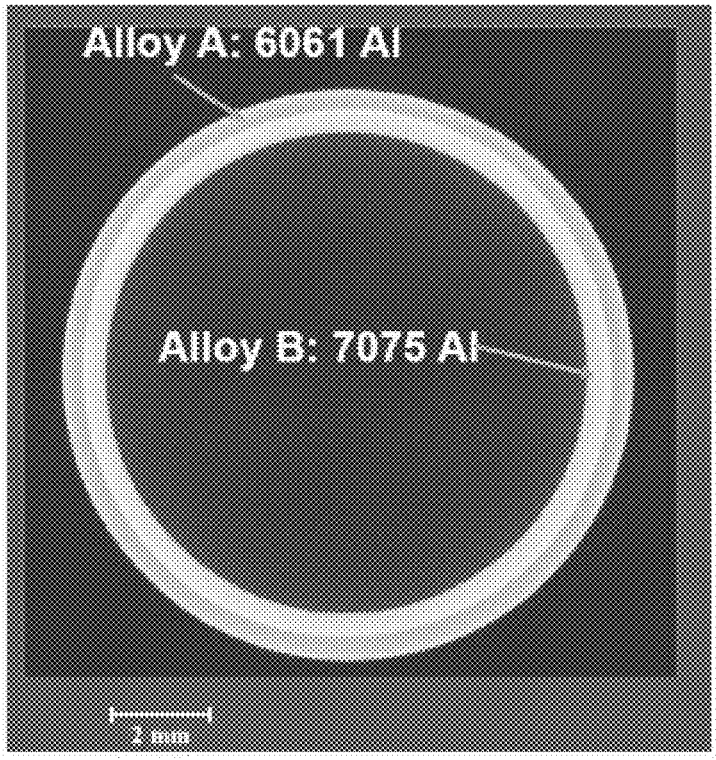
FIG. 27 is a depiction of a multi-metallic extrudate according to an embodiment of the disclosure.
Figure 28:
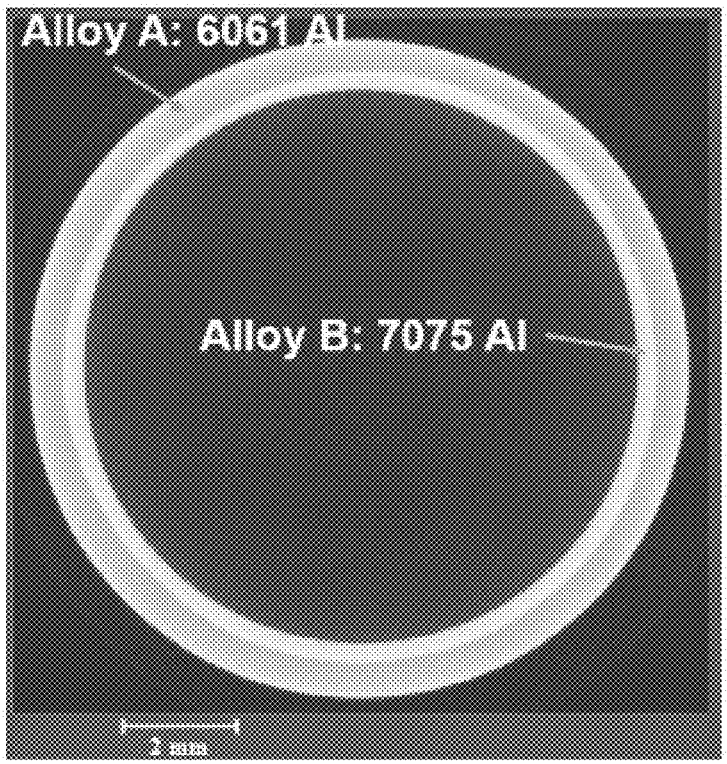
FIG. 28 is a depiction of a multi-metallic extrudate according to an embodiment of the disclosure.

In accordance with an example implementation, at least a pair of billet designs are shown in FIGS. 23A-23B and 24A-24B. FIGS. 23A-23B demonstrate a similar thickness while FIGS. 24A-24B demonstrate an inner ⅓ to outer ⅔ ratio. The materials used were inner 7075 and outer 6061. In FIGS. 25A-28 analysis results of both FIGS. 23A-B and 24A-B designs are shown.

Successful extrudate fabrication of distinctly different flow strength materials can provide heat exchangers with high temperature strength materials having a corrosion/oxidation resistance material as either an inner or outer material. At least one example of this application is co-extrusion of copper-nickel bi-metallic tubing which has been performed using these methods. Moreover, the apparatus and methods described herein enable continuous cladding from start to stop. For example, the outer material can be present over an entirety of an extrudate surface. Additionally, or alternatively, the apparatus and method provide the ability to vary or change outer material thickness. That is, a thicker and/or thinner outer material may be continuously fabricated along an outer surface of the extrudate.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A shear assisted extrusion assembly, the assembly comprising:

a billet containing assembly configured for receiving a billet comprising a billet outer material and a billet inner material in at least one cross-section, wherein the billet outer material and the billet inner material are not bonded;

a tool configured to operably engage the billet outer material and billet inner material; and an extrudate receiving channel configured to receive extrudate from the tool, the extrudate comprising extruded outer material and extruded inner material in at least one cross-section;

wherein:

the extruded outer material is the same material as the billet outer material, and the extruded inner material is the same material as the billet inner material; and the extruded inner material and the extruded outer material are bonded at an interface therebetween.

2. The assembly of claim 1 wherein the billet further comprises a billet intermediate material between the billet outer material and the biller inner material in the at least one cross-section.

3. The assembly of claim 2 wherein the extrudate further comprises extruded intermediate material between the extruded outer material and the extruded inner material in the at least one cross-section.

4. The assembly of claim 1 further comprising a mandrel extending from the billet containing assembly to the tool;

wherein the mandrel extends through an opening in a die face of the tool.

5. The assembly of claim 1 further comprising a billet boundary material lateral of either the billet inner or outer material.

6. The assembly of claim 5 wherein:

the billet boundary material is lateral of the billet inner material, and the billet boundary material is the same material as the billet outer material.

7. The assembly of claim 6 wherein the billet boundary material is lateral of the billet outer material.

8. The assembly of claim 5 wherein the billet boundary material comprises a different material than either or both of the billet inner or outer materials.

9. The assembly of claim 5 wherein in at least one cross-section the thickness of the inner and outer billet materials is different.

10. The assembly of claim 1, further comprising the billet.

11. A method for producing a multi-material shear assisted extrudate, the method comprising:

positioning a billet to be operably engaged with a tool, the billet comprising billet inner material and billet outer material, wherein the billet inner material and the billet outer material are not bonded; and providing shear-assisted force to the tool operably engaged with the billet to form an extrudate comprising extruded inner material and extruded outer material, wherein:

the extruded outer material is the same material as the billet outer material, and the extruded inner material is the same material as the billet inner material; and the extruded outer material and the extruded inner material are bonded at an interface therebetween.

12. The method of claim 11 further comprising a billet intermediate material between the billet inner material and billet outer material.

13. The method of claim 12 wherein the billet intermediate material comprises a single material.

14. The method of claim 12 wherein the billet intermediate material comprises multiple different materials.

15. The method of claim 11 wherein the inner and outer billet material are about the same thickness in at least one cross-section.

16. The method of claim 15 wherein the extruded inner and outer materials are about the same thickness in at least one cross-section.

17. The method of claim 11 wherein the inner billet material is 1/10 to 9/10 the thickness of the outer billet material.

18. The method of claim 17 wherein the extruded inner material is 1/10 to 9/10 of the thickness of the extruded outer billet material.

19. The method of claim 11 wherein the extruded materials define bonded interfaces between different unbound billet materials.

20. A shear assisted extrusion assembly, the assembly comprising:

a billet containing assembly containing a billet, the billet comprising a billet outer material and a billet inner material in at least one cross-section, wherein the billet outer material and the billet inner material are not bonded;

a tool configured to operably engage the billet outer material and billet inner material;

a mandrel extending from the billet containing assembly to the tool, wherein the mandrel extends through an opening in a die face of the tool; and an extrudate receiving channel configured to receive extrudate from the tool, the extrudate comprising extruded outer material and extruded inner material in at least one cross-section;

wherein:

the extruded outer material is the same material as the billet outer material, and the extruded inner material is the same material as the billet inner material; and the extruded inner material and the extruded outer material are bonded at an interface therebetween.

* * * * *